US012550990B2

(12) United States Patent
Fernandes

(10) Patent No.: US 12,550,990 B2
(45) Date of Patent: Feb. 17, 2026

(54) PORTABLE STORAGE APPARATUS

(71) Applicant: Thousand Oaks Corp., Irwindale, CA (US)

(72) Inventor: Tyler Fernandes, Irwindale, CA (US)

( * ) Notice: Subject to any disclaimer, the term of this patent is extended or adjusted under 35 U.S.C. 154(b) by 554 days.

(21) Appl. No.: 17/331,481

(22) Filed: May 26, 2021

(65) Prior Publication Data

US 2021/0368955 A1 Dec. 2, 2021

Related U.S. Application Data

(63) Continuation-in-part of application No. 29/735,934, filed on May 26, 2020, now Pat. No. Des. 941,578,
(Continued)

(51) Int. Cl.

| | |
|---|---|
| ***A45C 13/38*** | (2006.01) |
| ***A45C 5/06*** | (2006.01) |
| ***A45C 13/30*** | (2006.01) |

(52) U.S. Cl.
CPC ..... *A45C 13/38* (2013.01); *A45C 5/06* (2013.01); *A45C 13/30* (2013.01); *A45C 2013/306* (2013.01)

(58) Field of Classification Search
CPC ..... A45C 13/38; A45C 5/06; A45C 13/30; A45C 2013/306
(Continued)

(56) References Cited

U.S. PATENT DOCUMENTS

| | | | |
|---|---|---|---|
| 258,393 | A | 5/1882 | Endicott |
| 1,482,678 | A | 2/1924 | Figley |

(Continued)

FOREIGN PATENT DOCUMENTS

| | | | |
|---|---|---|---|
| CN | 101066048 | A | 11/2007 |
| CN | 101088330 | A | 12/2007 |

(Continued)

OTHER PUBLICATIONS

Academy, "H20 Xpress Pro Tackle Bag II," on sale at least as of Apr. 1, 2022 (https://www.academy.com/p/h20-xpress-pro-tackle-bag-ii?sku=blue ) (Year: 2022).

(Continued)

*Primary Examiner* — Nathan J Jenness
*Assistant Examiner* — Justin Caudill
(74) *Attorney, Agent, or Firm* — J. Andrew Reed; Think Differently Legal, PLLC

(57) ABSTRACT

A storage apparatus configured for securing, transporting and accessing storage containers. The storage apparatus includes a storage void defined by at least four walls that are comprised of a semi-rigid material that allows for integration of the walls to one another with a single overlapping seam. The storage void is configured to receive one or more storage containers that are visibly discernable from each other in the storage void. A portion of the one or more storage containers is configured to be visible from above the walls when each of the one or more storage containers is stored vertically or horizontally within the storage void. The storage apparatus also may include a fluid resistant material cover having at least one elastic member configured to secure against the walls.

17 Claims, 16 Drawing Sheets

Related U.S. Application Data and a continuation-in-part of application No. 29/735,931, filed on May 26, 2020, now Pat. No. Des. 941,577.

(60) Provisional application No. 63/030,151, filed on May 26, 2020.

(58) Field of Classification Search
USPC ..... 206/223, 570
See application file for complete search history.

(56) References Cited

U.S. PATENT DOCUMENTS 1,791,346 A 2/1931 Burch et al.
2,028,339 A * 1/1936 Levine ..... A45C 13/03 190/100
2,102,977 A 12/1937 Shoemaker et al.
2,316,833 A 4/1943 Baron
2,554,668 A * 5/1951 Doppelt ..... A45C 13/03 206/289
2,595,463 A 5/1952 Kamps
2,616,209 A 11/1952 Ploen
2,717,470 A 9/1955 Holdeman
2,730,833 A 1/1956 Newell
2,956,365 A 10/1960 Smith et al.
2,987,846 A 6/1961 Powell
3,047,349 A 7/1962 Powell
3,122,225 A 2/1964 Ward
3,181,751 A 5/1965 Jean
RE25,826 E 8/1965 Ward
3,310,271 A 3/1967 King
3,481,066 A 12/1969 Woolworth
3,564,755 A 2/1971 Lindgren, Sr.
3,813,138 A 5/1974 Doohan
3,842,976 A * 10/1974 Dea ..... B65D 1/24 206/811
3,850,396 A 11/1974 Orlandi
3,985,409 A 10/1976 Kneier
4,023,304 A 5/1977 Singer
4,151,938 A 5/1979 Barker et al.
4,169,550 A 10/1979 Williams
4,176,491 A 12/1979 Herring
D257,651 S 12/1980 Katz et al.
4,240,222 A 12/1980 Covington
4,245,422 A 1/1981 Souza
4,324,446 A 4/1982 LeSage
D280,260 S 8/1985 Leiserson
D284,333 S 6/1986 Huston
D284,620 S 7/1986 Calton
D291,149 S 8/1987 Smith
4,739,886 A 4/1988 Seaberg
4,769,941 A 9/1988 Schmidt
D299,587 S 1/1989 Thomas
4,811,996 A 3/1989 Hansson
4,854,432 A 8/1989 Carpenter et al.
4,958,730 A 9/1990 Bunten
D311,452 S 10/1990 Ehret
D312,530 S 12/1990 Gallen et al.
5,054,669 A 10/1991 Zimbardi et al.
5,087,105 A 2/1992 White
D333,038 S 2/1993 Collins
D336,218 S 6/1993 Hague
5,217,119 A 6/1993 Hollingsworth
D341,026 S 11/1993 Barker
5,261,529 A 11/1993 Holland
D347,521 S 6/1994 Elliott
D349,191 S 8/1994 Mason
D352,827 S 11/1994 Schildkraut
5,386,662 A 2/1995 Vader et al.
D360,182 S 7/1995 Lovett
5,454,477 A * 10/1995 Bornhorst ..... B65D 85/30 220/920
5,505,297 A * 4/1996 Myers ..... A45C 3/004 190/125
D371,051 S 6/1996 Melk
D371,052 S 6/1996 Melk
5,526,907 A 6/1996 Trawick
5,526,927 A 6/1996 McLemore
D371,724 S 7/1996 Melk
5,556,068 A 9/1996 Gorelik
D376,044 S 12/1996 Trawick et al.
5,606,820 A 3/1997 Suddeth
5,630,537 A 5/1997 Sciacca
D381,871 S 8/1997 Melk
D382,108 S 8/1997 Wheeler
D383,601 S 9/1997 Jones et al.
5,676,223 A 10/1997 Cunningham
D387,626 S 12/1997 Melk
D389,305 S 1/1998 Hauschild
D394,552 S 5/1998 Melk
5,762,170 A 6/1998 Shyr et al.
5,769,260 A 6/1998 Killinger et al.
5,772,066 A 6/1998 Reynolds
D396,745 S 8/1998 Peterson
D398,083 S 9/1998 Martz
D401,062 S 11/1998 Hauschild
5,829,185 A 11/1998 Myers
5,908,147 A 6/1999 Chuang
D412,269 S 7/1999 Wyant
D414,932 S 10/1999 Platte, III
D416,680 S 11/1999 Latshaw
D423,779 S 5/2000 Goatcher
D427,768 S 7/2000 Bogert
D435,343 S 12/2000 Eskandry
6,202,865 B1 3/2001 Kuo
6,202,910 B1 3/2001 Swetish
6,290,040 B1 9/2001 Chen
6,321,912 B1 11/2001 Lippert et al.
D452,806 S 1/2002 King
6,454,097 B1 * 9/2002 Blanco ..... A61F 17/00 206/570
D465,086 S 11/2002 Watts
D465,134 S 11/2002 Joss
D468,101 S 1/2003 Hassett
D469,606 S 2/2003 Su
6,516,927 B2 * 2/2003 Krulik ..... A45C 3/02 190/902
D471,012 S 3/2003 Peterson
6,530,475 B1 3/2003 Penney
D472,380 S 4/2003 Hillman
D472,386 S 4/2003 Bauer
D474,598 S 5/2003 Platte, III
D476,480 S 7/2003 Hillman
6,595,604 B1 7/2003 Peterson
6,612,434 B1 9/2003 Redzisz
D481,204 S 10/2003 Rada
D482,525 S 11/2003 Fair
D482,842 S 12/2003 Fair
D484,695 S 1/2004 DePalma
D485,144 S 1/2004 Levine et al.
D487,189 S 3/2004 Ukitsu et al.
D487,191 S 3/2004 Ong
D492,160 S 6/2004 Lanman et al.
6,742,636 B2 * 6/2004 Godshaw ..... A45C 5/06 190/102
D495,489 S 9/2004 Messina-Brown
6,821,019 B2 11/2004 Mogil
D504,229 S 4/2005 Duvigneau
D506,061 S 6/2005 McGibben
D507,734 S 7/2005 Willems
6,926,136 B1 8/2005 Lynch-Bass
D514,317 S 2/2006 Conforti
D528,295 S 9/2006 Harvey
D530,089 S 10/2006 Silverman
7,162,890 B2 1/2007 Mogil et al.
D542,031 S 5/2007 Zapata
7,240,513 B1 7/2007 Conforti
D552,350 S 10/2007 Bosley
D556,452 S 12/2007 Hydon
D560,450 S 1/2008 Tagliati et al.
D566,393 S 4/2008 Kidakarn
D574,615 S 8/2008 Picot et al.

(56) References Cited

U.S. PATENT DOCUMENTS 7,467,695 B2 * 12/2008 Gormick ..... A45C 13/42 190/18 R
7,568,566 B2 8/2009 D'Ambrosio
7,604,103 B2 10/2009 Hamlin
D603,169 S 11/2009 Smith
7,621,074 B2 11/2009 Glidewell et al.
D620,254 S 7/2010 Noraker
7,837,032 B2 11/2010 Smeltzer
D634,543 S 3/2011 Scicluna et al.
D634,601 S 3/2011 Good
7,937,884 B1 5/2011 Naylor et al.
7,941,965 B2 5/2011 Hoover
D639,051 S 6/2011 Dare
D647,301 S 10/2011 Sosnovsky
8,043,004 B2 10/2011 Mogil
D648,533 S 11/2011 Sosnovsky
D660,589 S 5/2012 Ayjian
8,348,510 B2 1/2013 Mogil
D676,652 S 2/2013 Holloway et al.
8,453,813 B2 6/2013 Lai
D692,661 S 11/2013 Gupton
D692,662 S 11/2013 Pignotti
8,621,720 B2 1/2014 Kao et al.
D714,541 S 10/2014 Anderson et al.
D720,216 S 12/2014 Luburic et al.
8,899,071 B2 12/2014 Mogil
D724,318 S 3/2015 Myer
D725,908 S 4/2015 Zwetzig
D739,653 S 9/2015 Majeau et al.
9,144,281 B2 9/2015 Cross
D742,637 S 11/2015 Miles
9,226,557 B2 1/2016 Sullivan
D748,918 S 2/2016 Majeau
D761,564 S 7/2016 Rhodes
D762,384 S 8/2016 Boroski
D762,978 S 8/2016 Boroski
9,462,874 B1 10/2016 Samuel
D779,824 S 2/2017 Boroski
D781,575 S 3/2017 Etekochay
D787,816 S 5/2017 Slimane
D793,728 S 8/2017 Faibish et al.
D796,188 S 9/2017 Ho et al.
D802,913 S 11/2017 Tien
9,854,897 B1 * 1/2018 Pelkey, Jr. ..... H01M 50/267
D811,727 S 3/2018 Quehl et al.
D818,204 S 5/2018 Renforth
D821,097 S 6/2018 Burton et al.
D824,170 S 7/2018 Tobias
D828,112 S 9/2018 Furneaux
D831,952 S 10/2018 Pennington
D832,653 S 11/2018 Waskow et al.
D833,141 S 11/2018 Carter et al.
D835,473 S 12/2018 Jacobsen
D835,950 S 12/2018 Jacobsen
D836,999 S 1/2019 Jacobsen
D837,000 S 1/2019 Jacobsen
D837,001 S 1/2019 Jacobsen
D838,971 S 1/2019 Deanda
D843,107 S 3/2019 Swaggart
D844,324 S 4/2019 Hoppe et al.
D845,613 S 4/2019 Decker
D849,398 S 5/2019 Tan
D856,662 S 8/2019 Breines
D862,528 S 10/2019 Sullivan et al.
10,477,991 B1 11/2019 Fragala
D873,090 S 1/2020 Jacobsen
D874,129 S 2/2020 Goldstein
D875,385 S 2/2020 Carter et al.
D880,253 S 4/2020 Jacobsen
D881,655 S 4/2020 Jacobsen
D887,135 S 6/2020 Tan
D887,136 S 6/2020 Tan
D888,413 S 6/2020 Dai
D889,821 S 7/2020 Xu
D890,517 S 7/2020 Smith
D893,183 S 8/2020 Eisenhardt et al.
D896,504 S 9/2020 Li
D896,505 S 9/2020 Yuan
D896,514 S 9/2020 Tan
D898,349 S 10/2020 He
D899,079 S 10/2020 Priest
D901,882 S 11/2020 Tan
10,881,178 B2 1/2021 Johnson
D912,974 S 3/2021 Breines
D915,762 S 4/2021 Li
D915,770 S 4/2021 Breines
10,973,206 B2 * 4/2021 Friedgood ..... A01K 7/005
D919,287 S 5/2021 He
D920,744 S 6/2021 Eisenhardt et al.
D922,061 S 6/2021 Tan
D922,062 S 6/2021 Shi
D927,174 S 8/2021 Dai
D927,261 S 8/2021 Rong
11,076,666 B2 8/2021 Sullivan et al.
D931,600 S 9/2021 Huang
11,116,297 B1 * 9/2021 Latham ..... B65D 81/02
D932,179 S 10/2021 Mukri
D938,717 S 12/2021 Tan
D941,578 S 1/2022 Fernandes
D944,004 S 2/2022 Tan
11,242,189 B2 2/2022 Rogers
D947,524 S 4/2022 Tan
D964,021 S 9/2022 Wu
D964,123 S 9/2022 Peng
D979,244 S 2/2023 Luo
D982,316 S 4/2023 Miao
D984,119 S 4/2023 De Abreu
11,673,344 B2 6/2023 Chen
2001/0042665 A1 * 11/2001 Siwak ..... A45C 5/06 190/111
2002/0181806 A1 * 12/2002 Godshaw ..... A45C 7/0063 383/110
2003/0234269 A1 12/2003 Shamas
2004/0065573 A1 4/2004 Brouard
2004/0149600 A1 8/2004 Wolter et al.
2005/0011904 A1 * 1/2005 Godshaw ..... A45F 5/021 220/796
2005/0016648 A1 1/2005 Vakharia et al.
2005/0077135 A1 * 4/2005 Drew ..... A45C 13/00 190/110
2005/0082132 A1 4/2005 Smith
2005/0121275 A1 6/2005 Platte
2005/0161483 A1 7/2005 Krohn
2005/0263364 A1 12/2005 Sher
2005/0279124 A1 12/2005 Maldonado
2006/0064852 A1 3/2006 Willems
2007/0011939 A1 1/2007 Sakai
2007/0214613 A1 9/2007 Shiao
2007/0228097 A1 10/2007 Recanati
2007/0237432 A1 10/2007 Mogil
2007/0245521 A1 10/2007 Chehebar
2008/0029666 A1 2/2008 Hurt
2008/0116026 A1 5/2008 Bass et al.
2008/0121554 A1 * 5/2008 Townsend ..... A45C 5/06 206/570
2008/0164265 A1 7/2008 Conforti
2008/0289925 A1 11/2008 Sapyta
2009/0052809 A1 * 2/2009 Sampson ..... B65D 81/389 220/592.2
2009/0294237 A1 * 12/2009 Sisitsky ..... A45C 11/20 190/110
2009/0301911 A1 12/2009 Rubin
2012/0043228 A1 2/2012 Ezzo et al.
2012/0286011 A1 * 11/2012 Wegener ..... B62K 3/002 224/627
2013/0043293 A1 2/2013 Connell
2013/0068776 A1 * 3/2013 Patterson ..... F25D 3/08 220/592.01
2013/0145581 A1 6/2013 Bailey
2014/0132131 A1 5/2014 Thomas
2014/0290025 A1 10/2014 Custer
2014/0360831 A1 12/2014 Kao

(56) References Cited

U.S. PATENT DOCUMENTS

| | | | | |
|---|---|---|---|---|
| 2015/0014108 | A1* | 1/2015 | Vecellio | A45C 13/02 190/100 |
| 2015/0101958 | A1 | 4/2015 | Cross | |
| 2016/0205913 | A1 | 7/2016 | Aston et al. | |
| 2016/0244239 | A1 | 8/2016 | Nash | |
| 2016/0374440 | A1 | 12/2016 | Lundy et al. | |
| 2017/0073146 | A1 | 3/2017 | Kuhn et al. | |
| 2018/0220759 | A1 | 8/2018 | Johnson | |
| 2018/0252458 | A1 | 9/2018 | Furneaux et al. | |
| 2018/0343995 | A1* | 12/2018 | Dingler | A45C 7/0068 |
| 2019/0200715 | A1* | 7/2019 | Peris | A61B 50/31 |
| 2020/0077760 | A1 | 3/2020 | Grill et al. | |
| 2020/0205537 | A1 | 7/2020 | Franco | |
| 2020/0228056 | A1 | 7/2020 | Miller | |
| 2021/0007451 | A1* | 1/2021 | Tan | A45C 7/009 |
| 2021/0007452 | A1 | 1/2021 | Tan | |
| 2021/0009313 | A1 | 1/2021 | Tan | |
| 2021/0068510 | A1 | 3/2021 | Johnson | |
| 2021/0212442 | A1 | 7/2021 | Webb | |
| 2023/0027563 | A1 | 1/2023 | Fadal et al. | |
| 2023/0232952 | A1 | 7/2023 | Zucco | |

FOREIGN PATENT DOCUMENTS

| | | | |
|---|---|---|---|
| CN | 201360487 | | 12/2009 |
| CN | 102972367 | A | 3/2013 |
| CN | 205357836 | U | 7/2016 |
| CN | 305294327 | | 8/2019 |
| EP | 0071274 | A2 | 2/1983 |
| GB | 6119047 | | 2/2021 |
| JP | H07241210 | A * | 9/1995 |
| JP | D1173649 | | 5/2003 |

OTHER PUBLICATIONS

Amazon, "Westfield Fishing Tackle Bag Water Resistant Soft Sided Waist Shoulder Carry Storage Hiking Climbing Fly," on sale at least as of Apr. 1, 2022 (https://www.amazon.co.uk/Westfield-Fishing-Resistant-Shoulder-Climbing/dp/B01H6WE47Y) (Year: 2022).

Bass Pro Shops, "Bass Pro Shops Advanced Anglers II Large Tackle System," on sale at least as of 204-01-2022, (https://www.basspro.com/shop/en/bass-pro-shops-advanced-anglers-ii-large-tackle-system) (Year: 2022).

Bass Pro Shops, "Cabela's Extreme Wide-Top Tackle Bag," on sale at least as of Apr. 1, 2022 (https://www.basspro.com/shop/en/cabelas-extreme-wide-top-3600-tackle-bag) (Year: 2022).

Bass Pro Shops, "Plano B-Series 3600 Tackle Bag," on sale at least as of Apr. 1, 2022 (https://www.basspro.com/shop/en/plano-b-series-3600-tackle-bag) (Year: 2022).

Walmart, "Ozark Trail 370 Large Pro Quick Access Soft Sided Fishing Tackle Bag", on sale at least as of Apr. 1, 2022. (https://www.walmart.com/ip/Ozark-Trail-370-Large-Pro-Quick-Access-Soft-Sided-Fishing-Tackle-Bag-Black/474776073 ) (Year: 2022).

5.11 Tactical 56298-092-1SZ-UCR 13.7L Storm Tactical Sling Bag; unknown first available date, recreationid.com [online], [site visited Nov. 24, 2020], Available from internet U RL:https://www.recreationid.com/511tactical/ucr-13-7-I-storm-tactical-sling-bag-mpn-56298-092-1-sz.html (Year: 2020).

5007 Flambeau Pro-Angler Sling Pack (Kinetic Blue), unknown first available date, evolutionoutdoor.com [online], [site visited Nov. 24, 2020], Available from internet U RL:https://evolutionoutdoor.com/products/5007-flambeau-pro-angler-sling-pack-kinetic-blue?variant=35241408331932 (Year: 2020.

Amazon, "Evolution Outdoor Design Large Mouth Double Decker Mossy Oak Tackle Backpack 3600 Manta Grey Camo Evolution", Date first listed on Amazon Sep. 14, 2017. (https://www.amazon .com/Evolution-Outdoor-Design-Backpack-Fishing/dp/B07PJWZXHY) (Year: 2017).

Amazon, "Flambeau 4007 Heritage Tackle Bag, Fir Green/Pewter/Rust, FL40001", First on sale Apr. 23, 2020. (https://www.amazon.com/Fiambeau-Heritage-Bait-Binder/dp/B089469PPT) (Year: 2020).

Amazon, "Piscifun Fishing Tackle Backpack with 4 Trays Large Waterproof Tackle Bag Storage . . . ", First review Jun. 2, 2018. (https://www .amazon .com/Piscifun-Backpack-Capacity-Waterproof-Protective/dp/B07CGJ DTN GI} (Year: 20 18).

Evolution Outdoor Drift Series Topless Horizontal Tackle Bag, first available Feb. 24, 2021, amazon.com [online], [site visited Jun. 28, 21], Available at internet URL: https://www.amazon.com/Evolution-Outdoor-Topless-Horizontal-Tackle/dp/B08WRNXBXV?th=1&psc=1 (Year: 2021).

Evolution Outdoor Drift Series Topless Vertical Tackle Bag, first available Mar. 2, 2021, amazon.com [online], [site visited Jun. 28, 2021], Available at internet URL: https://www.amazon.com/Evolution-Outdoor-Topless-Vertical-Tackle/dp/B08WRVCF31?th=1 (Year: 2021).

Flambeau 5007 Pro-Angler Tackle Bag (Grey/Red), first available Apr. 23, 2020, amazon.com [online], [site visited Nov. 24, 2020], w Available from internet U RL: https://www.arnazon .corn/Fiarnbeau-5007 -Pro-Angler-Tackle-Grey/dp/ B089458PL7 /ref=sr _1_22?dchild=1&gclid=EAiaiQobCh M 10uut0b6b 7QIVCDiGC% E2%80% A6 (Year: 2020).

Flambeau Heritage 4007 Tackle Bag, unknown first available date, DicksSportingGoods.com [online], [site visited Nov. 24, 2020], Available from internet U RL: https://www.dickssportinggoods.com/p/flambeau-heritage-4007-tackle-bag-20fmbaflmbhrtg3 70tbx/20fmbaflmbhrtg370tbx?sku=21521402&camp=CSE:%E2%80% A6 (Year: 2020).

International Search Report and Written Opinion dated May 19, 2017 of PCT Application No. PCT/US2016/047971, 14 pages.

KastKing Fishing Tackle Bag, first available Jun. 27, 2018, amazon.com [online], [site visited Jun. 28, 2021], Available at internet URL: https://www.amazon.com/KastKing-Saltwater-Waterproof-Medium-Hoss-15x11x10-25/dp/B07XRFSFPN/ref=pd_Ipo_3?pd_rd_i=B07F2GH9VS&psc=1 (Year: 2018).

KastKing Fishing Tackle Bags, first available Jun. 27, 2018, amazon.com [online], [site visited Nov. 14, 2018], Available from internet U R L: https : 1/www .amazon. com/d p/BO7F2HV28F/ref=sspa_dk_ detail_6?pd_rd_i=BO7XRFSFPN&pd_rd_w=a6HTH&pf_rd_p7d37a48b-2b1a-4373-8c1a-bd%E2%80%A6 (Year: 2018).

Okuma Fishing Tackle Soft Sided Tackle Bag, first available Oct. 23, 2015, amazon.com [online], [site visited Nov. 24, 2020], Available from internet U RL: https://www.arnazon.com/Okurna-Fishing-Tackle-Soft-Sided/dp/B018M56S28 (Year: 2015).

Plano Guide Series Tackle Bag, first available Feb. 10, 2020, amazon.com [online], [site visited Jun. 28, 2021], Available at internet URL: https://www.amazon.com/Piano-Premium-Storage-included-PLABG371/dp/B084NQLFMH/ref=pd_Ipo_2?pd_rd_i=B084NQLFMH&psc=1 (Year: 2020).

Reebow Gear Tactical Sling Bag . . . , first available Jan. 7, 2018, amazon.com [online], [site visited Nov. 24, 2020], Available frominternet U RL: https://www.amazon .com/Tacticai-Siing-Military-Shoulder-Backpack/dp/B0768G7H9N?th= 1 (Year. 2018).

Walmart—Ozark Trail Outdoor Equipment "Mesh Bottom Tackle Bag"—As early as 2019.

U.S. Appl. No. 29/777,817, filed Apr. 8, 2021, Tyler Fernandes.

U.S. Appl. No. 29/800,531, filed Jul. 21, 2021, Colt Fadal.

Evolution fishing drift series tackle backpack, posted at amazon.com, first available Feb. 23, 2022, retrieved on Jun. 6, 2023, online, https://www.amazon.com/Evolution-Fishing-Drift-Tackle-Backpack/dp/B09T5W2TXF (Year: 2022).

Igogi fishing tackle backpack, posted at amazon.com, first available Jul. 8, 2021, retrieved on Jun. 6, 2023, online, https://www.amazon.com/IGOGI-Fishi ng-Backpack-Holders-Without/dp/B098WPZY25 (Year: 2021).

Piscifun fishing tackle backpack, posted at amazon.com, first available Apr. 16, 2018, retrieved on Jun. 6, 2023, online, https://www.amazon.com/Piscifun-Backpack-Capacity-Waterproof-Protective/dp/B07C7R9696 (Year: 2018).

* cited by examiner

PORTABLE STORAGE APPARATUS

CROSS-REFERENCE TO RELATED APPLICATIONS

This application claims the benefit of U.S. Provisional Application No. 63/030,151, filed May 26, 2020, which is incorporated herein by reference in its entirety. This application is related to U.S. Design patent application Ser. No. 29/735,931, filed on May 26, 2020, and is related to U.S. Design patent application Ser. No. 29/735,934, filed on May 26, 2020, the disclosures of which are incorporated herein by reference.

BRIEF SUMMARY

The present disclosure provides an improved storage apparatus for securing, transporting and accessing storage containers. In at least one configuration, the storage apparatus includes a storage void defined by front, rear, left, right, and bottom walls. The walls are formed of a semi-rigid material that allows for integration of the walls to one another with a single overlapping seam. The storage void is configured to receive one or more storage containers that are visibly discernable from each other in the storage void. Each of the one or more storage containers has a depth that is less than its height and width. Each of the one or more storage containers has a portion substantially equal to the depth of each of the one or more storage containers. The portion is configured to be visible from above the front, rear, left, and right walls when each of the one or more storage containers is stored vertically within the storage void with its height being parallel to the bottom wall and the opening.

In at least another configuration, the storage apparatus includes a storage void defined by front, rear, left, right, and bottom walls. The walls are formed of a semi-rigid material that allows for integration of the walls to one another with a single overlapping seam. The storage void is configured to receive one or more storage containers that are visibly discernable from each other in the storage void. Each of the one or more storage containers has a depth that is less than its height and width. Each of the one or more storage containers has a portion substantially equal to the depth of each of the one or more storage containers. The portion is configured to be visible from above the front, rear, left, and right walls when each of the one or more storage containers is stored horizontally within the storage void with its height being parallel to the bottom wall and the opening.

In at least another configuration, the storage apparatus includes a storage void defined by front, rear, left, right, and bottom walls. The walls are formed of a semi-rigid material that allows for integration of the walls to one another with a single overlapping seam. The storage void is configured to receive one or more storage containers that are visibly discernable from each other in the storage void. Each of the one or more storage containers has a depth that is less than its height and width. Each of the one or more storage container has a portion substantially equal to the depth of each of the one or more storage containers. The portion is configured to be visible from above the front, rear, left, and right walls when each of the one or more storage containers is stored within the storage void. Additionally, a fluid resistant material cover having at least one elastic member is configured to secure against the front, rear, left, and right walls.

BRIEF DESCRIPTION OF THE DRAWINGS

For a fuller understanding provided by the disclosure, reference should be made to the following detailed description together with the accompanying drawings wherein.

DETAILED DESCRIPTION

Figure 1:
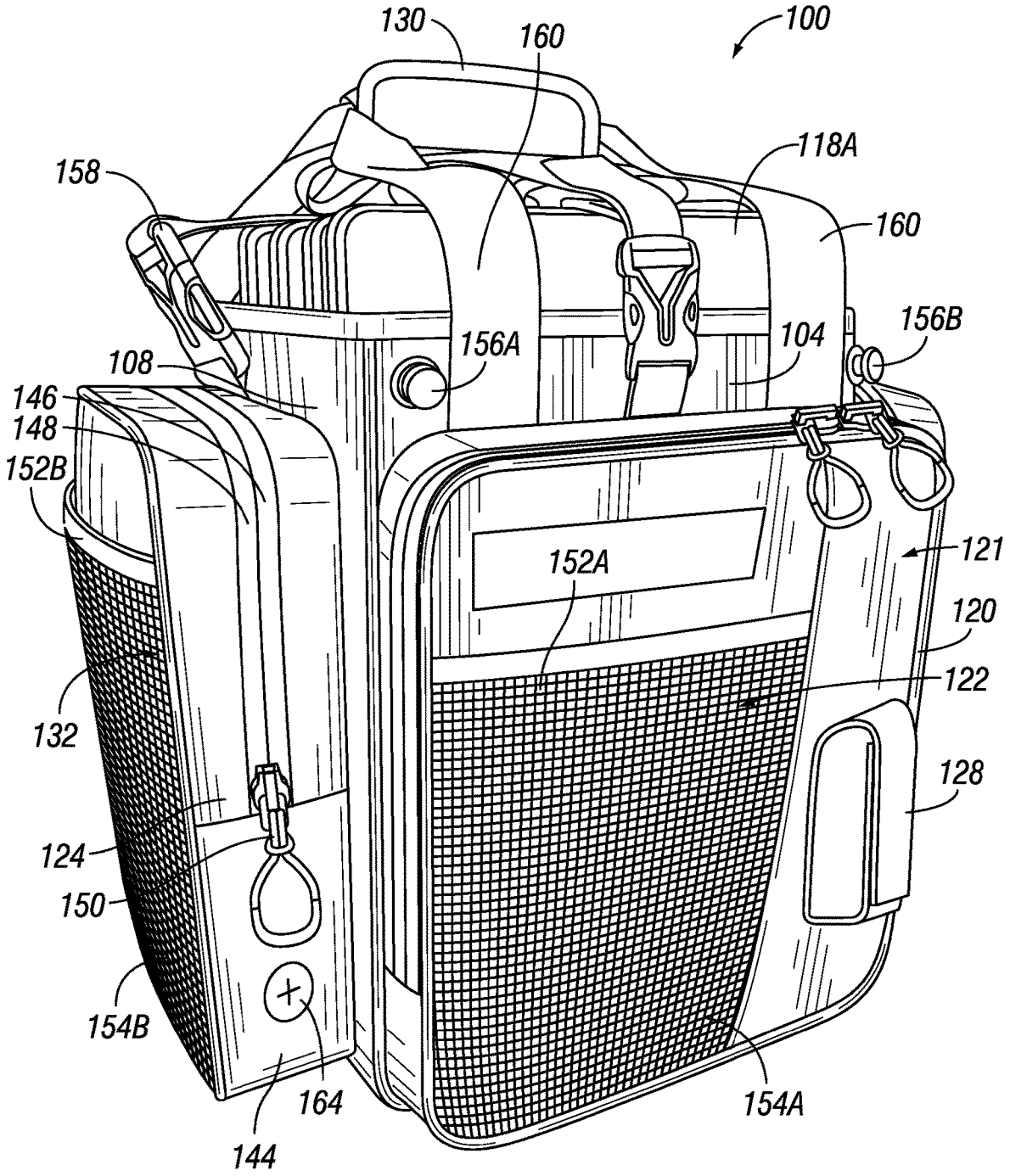
FIG. 1 is an illustration of a front perspective view of a storage apparatus.
Figure 7:
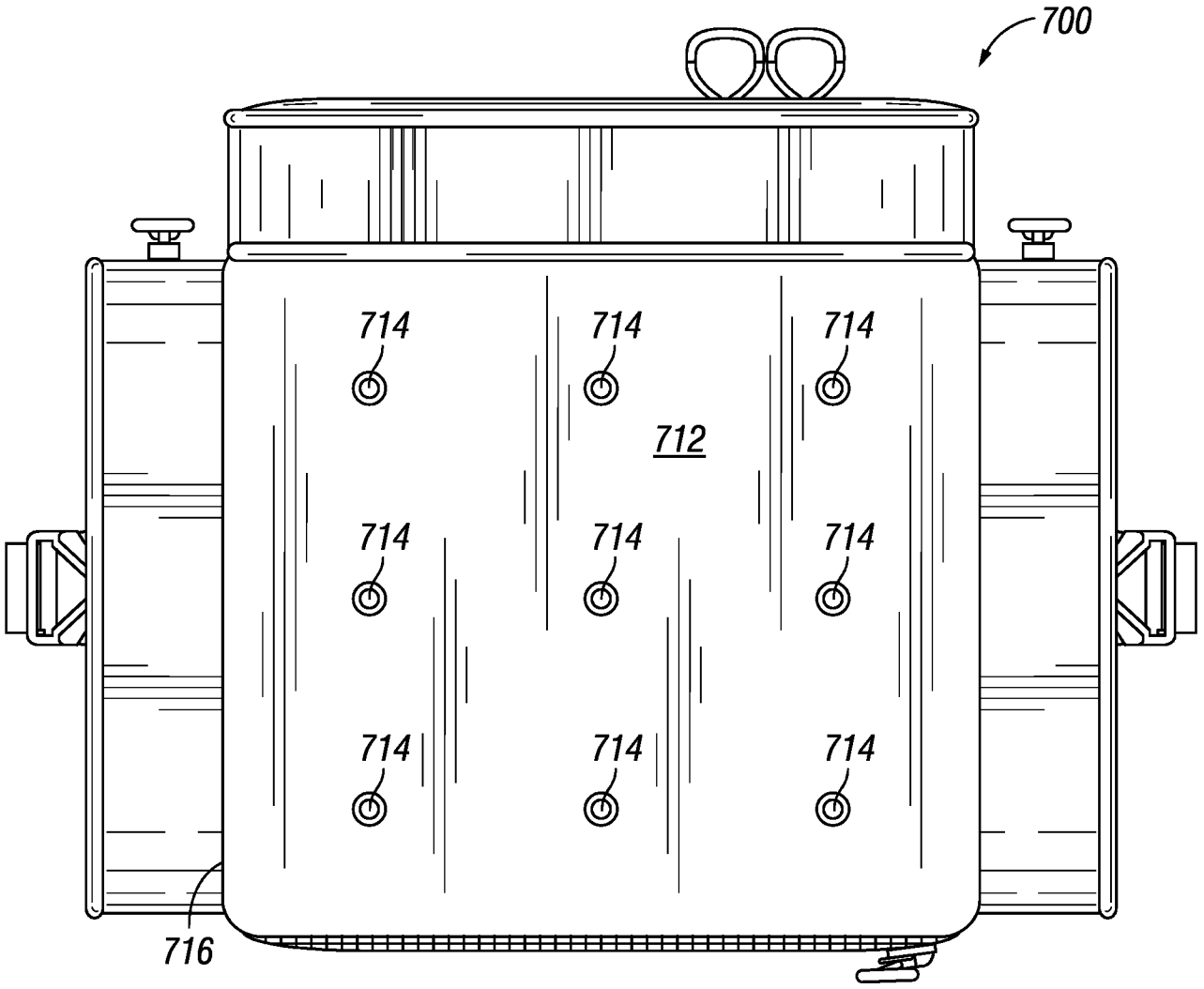
FIG. 7 is an illustration of a bottom view of a storage apparatus.

FIG. 1 is a front perspective view illustration of a configuration for a storage apparatus 100. The storage apparatus 100, in at least one embodiment, has a front wall 104, a rear wall (shown in FIG. 5), a left wall 108, and a right wall (shown in FIG. 4) that define a storage void. Each of the walls 104, 108, or other walls shown in other figures disclosed herein, may each have a storage pocket 120, 124, or in at least one example, a window pocket defined by a wall and an outer wall section. The walls are formed of a semi-rigid material that allows for integration of the walls to one another with a single overlapping seam 716 (FIG. 7). The storage pocket 120, 124 may have a bottom section 144 that is secured to a wall 104 or 108, as well as an inner connecting section 146, and an outer connecting section 148, wherein the connecting sections 146 or 148 are coupled by a securing mechanism 150. The connecting sections 146 or 148 and the securing mechanism 150 can be coupled together through a stitching or other connection type such as glue, magnets, buttons, snaps, or a combination thereof, or other connection types.

The storage pocket 120, 124, in at least one example, may also have a slip pocket 122, 132 having elastic 152A, 152B or other material having elastic properties and attached to the storage pocket 120, 124 or walls 104, 108. In some examples, the elastic 152A, 152B or other material may be combined with a webbing or mesh 154A, 154B that allows for a configuration that prevents items stored in the slip pocket 122, 132 from being released. The elastic 152A, 152B or other material may be attached to the storage pocket 120, 124 or wall 104, 108 through a stitching or other connection type such as glue, magnets, buttons, snaps, or a combination thereof, or other connection types.

Additional material sections 121 may be added to the storage pockets 120 or 124, or walls 104 or 108 for stability or accenting. In at least one example, the material sections may allow for a holster or loop strap 128 to be coupled to the storage apparatus 100. The holster or loop strap 128 can be configured to receive a coupling device(s) or items such as but not limited to carabiners, locks, rope, string, netting, coats, cases, cords, glasses, straps, combinations thereof, or other devices or items. A pass-through aperture or plug 164 may allow for cords or cables, such as but not limited to earphones, headphones, charging cables to pass through and be coupled to various devices. A set of securing points 156A or 156B can be coupled to wall 104 or 108 and configured to allow for a strap or fluid resistant cover to be utilized. In at least one example, a fluid resistant cover allows for fluid to be prevented from entering a storage void. One or more securing straps 158 may also be coupled to the walls 104 or 108, or storage pockets 120 or 124, to secure one or more storage containers 118A within a storage void 102. The securing straps 158 can utilize buckles or snaps, or other manners of securing, to ensure that the storage containers cannot be removed from the storage void without deliberate action from a user. In at least one example, the securing straps 158 may include multiple sections or portions that may individually be coupled to a wall 104 or 108, or storage pockets 120 or 124, at one end (first end), and have a portion of a multi-point securing mechanism at a second end distal from the first end, allow for all the sections or portions to be secured together. One or more carrying straps 160 may also be utilized, along with a handle 130 that may be coupled to one of the carrying straps 160 in some examples.

Figure 2:
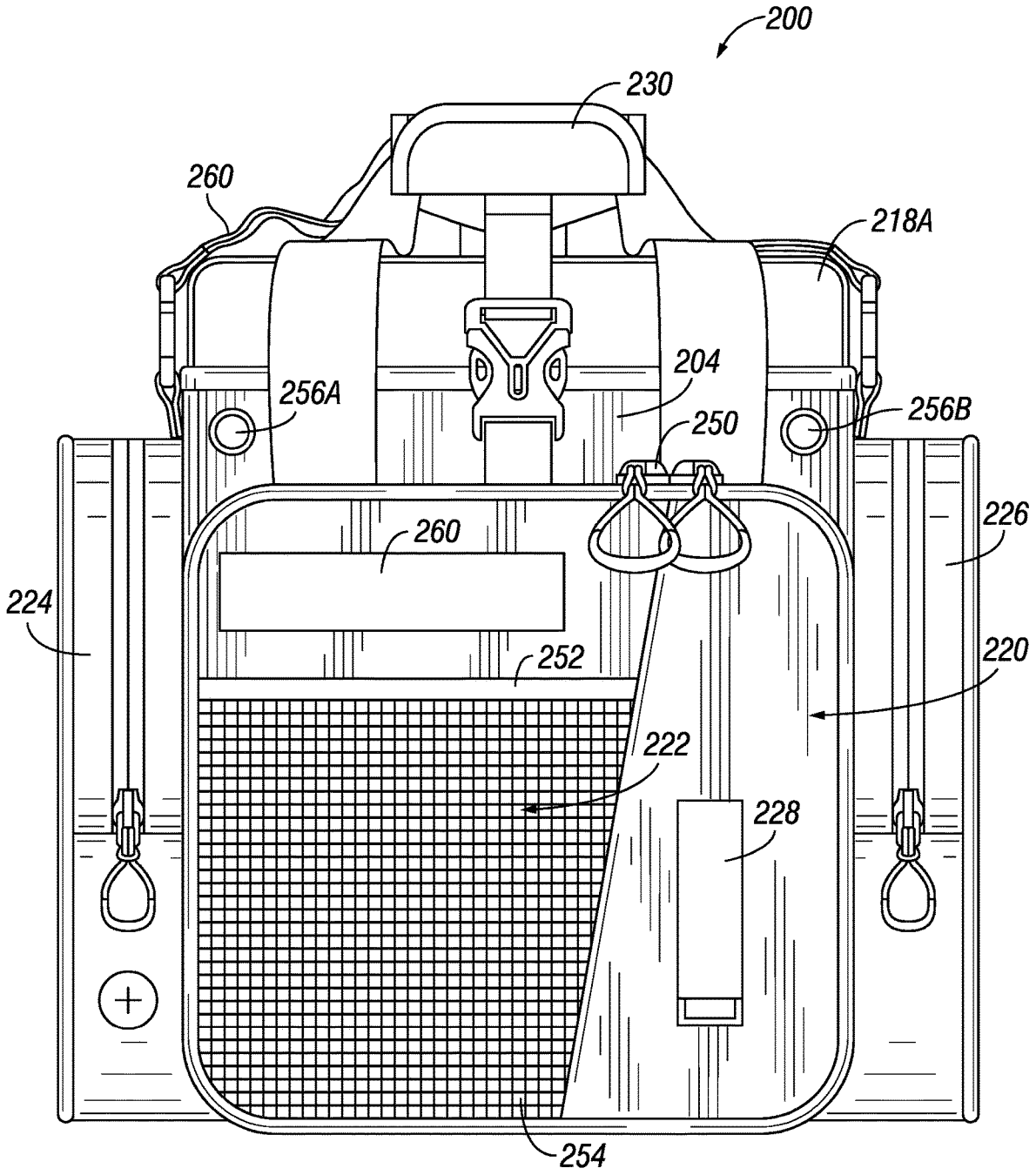
FIG. 2 is an illustration of a front elevation view of a storage apparatus.

FIG. 2 is a front elevation view illustration of a storage apparatus 200. The storage apparatus 200, in at least one embodiment, has a front wall 204, a rear wall (shown in FIG. 5), a left wall (shown as 108 in FIG. 1), and a right wall (shown in FIG. 4) that define a storage void. Each of the walls, or other walls shown in other figures disclosed herein, may each have a storage pocket 220 or in at least one example, a window pocket defined by a wall and an outer wall section. The storage pocket 220 may have a bottom section (shown as 144 in FIG. 1) that is secured to a wall 204, as well as an inner connecting section and an outer connecting section (shown as 146 and 148, respectively, in FIG. 1), wherein the connecting sections are coupled by a securing mechanism 250. The connecting sections and the securing mechanism 250 can be coupled together through a stitching or other connection type such as glue, magnets, buttons, snaps, or a combination thereof, or other connection types.

The storage pocket 220 in at least one example, may also have a slip pocket 222 having elastic 252 or other material having elastic properties and attached to the storage pocket 220 or wall 204. In some examples, the elastic 252 or other material may be combined with a webbing or mesh 254 that allows for a configuration that prevents items stored in the slip pocket 222 from being released. The elastic 252 or other material may be attached to the storage pocket 220 or front wall 204 through a stitching or other connection type such as glue, magnets, buttons, snaps, or a combination thereof, or other connection types.

Additional material sections may be added to the storage pockets 222, or wall 204 for stability or accenting. In at least one example, the material sections may allow for a holster or loop strap 228 to be coupled to the storage apparatus 200. The holster or loop strap 228 can be configured to receive a coupling device(s) or items such as but not limited to carabiners, locks, rope, string, netting, coats, cases, cords, glasses, straps, combinations thereof, or other devices or items. A pass-through aperture or plug may allow for cords or cables, such as but not limited to earphones, headphones, charging cables to pass through and be coupled to various devices. A set of securing points 256A or 256B can be coupled to wall 204 and configured to allow for a strap or fluid resistant cover to be utilized. In at least one example, a fluid resistant cover allows for fluid to be prevented from entering a storage void. One or more securing straps (shown as 158 in FIG. 1) may also be coupled to the walls or storage pockets 220 to secure one or more storage containers 218A within a storage void. The securing straps can utilize buckles or snaps, or other manners of securing, to ensure that the storage containers cannot be removed from the storage void without deliberate action from a user. In at least one example, the securing straps may include multiple sections or portions that may individually be coupled to a wall, or storage pockets 220 at one end (first end) and have a portion of a multi-point securing mechanism at a second end distal from the first end, to allow for all the sections or portions to be secured together. One or more carrying straps may also be utilized, along with a handle 230 that may be coupled to one of the carrying straps in some examples.

The storage pockets 220, 224, 226, or wall 204 may also have an advertising tag 260 that allows for branding or other accenting. In at least one example, the advertising tag 260 may be stitched, glued, or otherwise affixed to the storage pockets 220, 224, 226, or wall 204.

Figure 3:
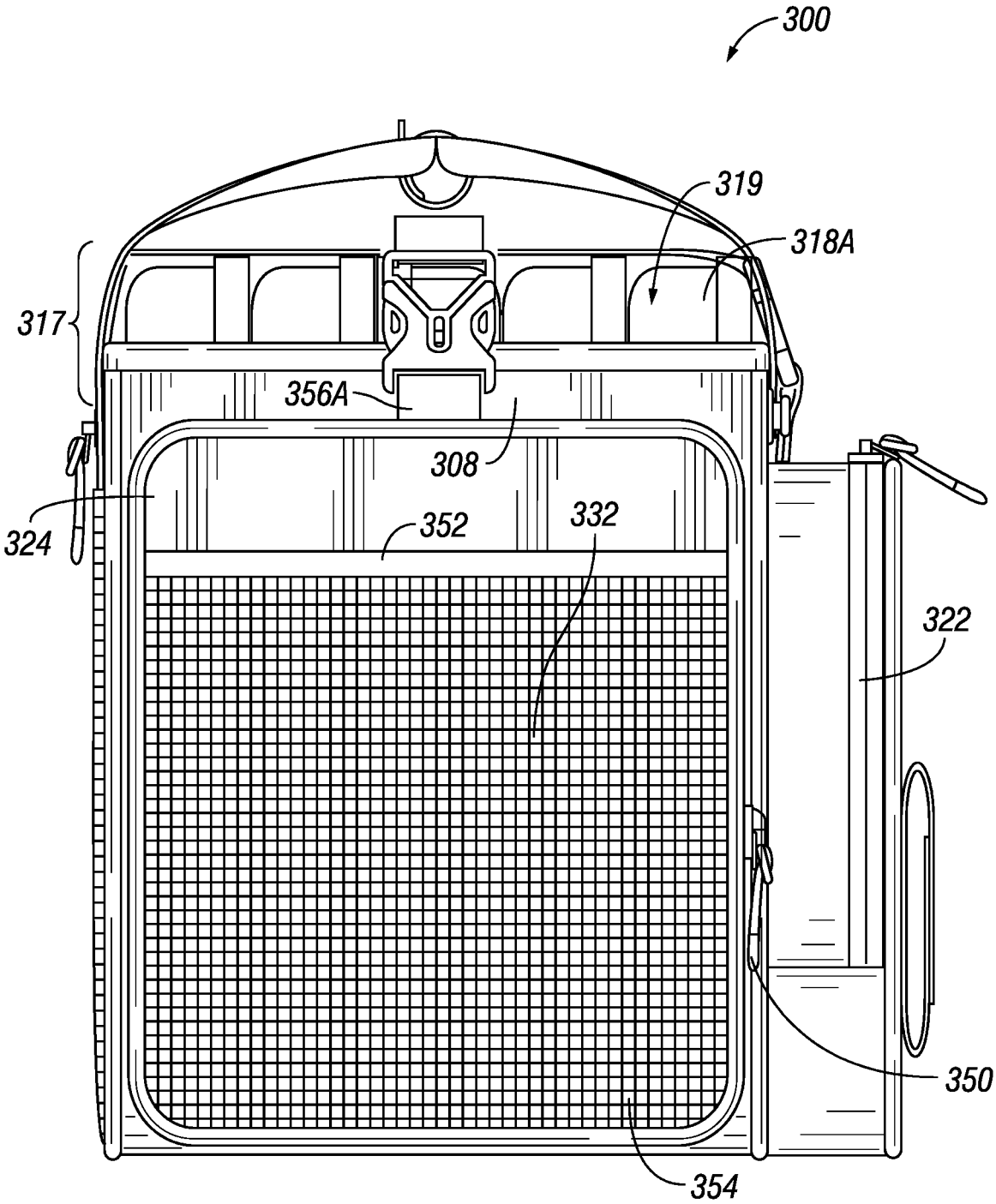
FIG. 3 is an illustration of a left side elevation view of a storage apparatus.

FIG. 3 is a left side elevation view illustration of a storage apparatus 300. The storage apparatus 300, in at least one embodiment, has a left wall 308, a rear wall (shown in FIG. 5), a right wall (shown in FIG. 2), and a front wall (shown in FIG. 1) that define a storage void. Each of the walls 308, or other walls shown in other figures disclosed herein, may each have a storage pocket 322, 324 or in at least one example, a window pocket defined by a wall and an outer wall section. The storage pocket 322, 324 may have a bottom section (shown in FIG. 1) that is secured to a wall 308, as well as an inner connecting section and an outer connecting section (shown in FIG. 1), wherein the connecting sections are coupled by a securing mechanism 350. The connecting sections and the securing mechanism 350 can be coupled together through a stitching or other connection type such as glue, magnets, buttons, snaps, or a combination thereof, or other connection types.

The storage pocket 324 in at least one example, may also have a slip pocket 332 having elastic 352 or other material having elastic properties and attached to the storage pocket 324 or wall 308. In some examples, the elastic 352 or other material may be combined with a webbing or mesh 354 that allows for a configuration that prevents items stored in the slip pocket 332 from being released. The elastic 352 or other material may be attached to the storage pocket 322, 324 or wall 308 through a stitching or other connection type such as glue, magnets, buttons, snaps, or a combination thereof, or other connection types.

Additional material sections may be added to the storage pockets 322, 324, or wall 308 for stability or accenting. In at least one example, the material sections may allow for a holster or loop strap to be coupled to the storage apparatus 300. The holster or loop strap can be configured to receive a coupling device(s) or items such as but not limited to carabiners, locks, rope, string, netting, coats, cases, cords, glasses, straps, combinations thereof or other devices or items. A pass-through aperture or plug may allow for cords or cables, such as but not limited to earphones, headphones, charging cables to pass through and be coupled to various devices. A set of securing points 356A can be coupled to wall 308 and configured to allow for a strap or fluid resistant cover to be utilized. In at least one example, a fluid resistant cover allows for fluid to be prevented from entering a storage void. One or more securing straps (shown in FIG. 1) may also be coupled to the wall 308, or storage pockets 322, 324, to secure one or more storage containers 318A within a storage void. The securing straps can utilize buckles or snaps, or other manners of securing to ensure that the storage containers cannot be removed from the storage void without deliberate action from a user. In at least one example, the securing straps may include multiple sections or portions that may individually be coupled to wall 308 or storage pockets 322, 324 at one end (first end) and have a portion of a multi-point securing mechanism at a second end distal from the first end, to allow for all the sections or portions to be secured together. One or more carrying straps may also be utilized, along with a handle that may be coupled to one of the carrying straps in some examples.

The storage containers 318A, which may be a set of storage containers 318A, allow for items to be stored or organized within the storage void. The storage containers 318A in at least one embodiment, have a two-tone or multi-tone coloring 319 that allows for a distinction between each of the storage containers 318A if different colors are utilized.

For example, a first storage container may be blue and black, while a second storage container is green and black, while a third storage container is red and blue. A user may keep a first type of devices in the first storage container, a second type of devices in the second storage container, and a third type of devices in the third storage container. The visual differences provided by the multi-tone coloring of the storage containers 318A allows for quick identification of which storage container contains which type of device or item. This quick identification is further assisted by the open nature of the storage void, which allows for a portion 317 of each storage container 318A to be visible above the wall 308, or other walls. In some examples, the multi-tone coloring 319 also can assist in preventing sun, ultraviolet, or other finish damage to items stored within the storage containers 318A.

Figure 4:
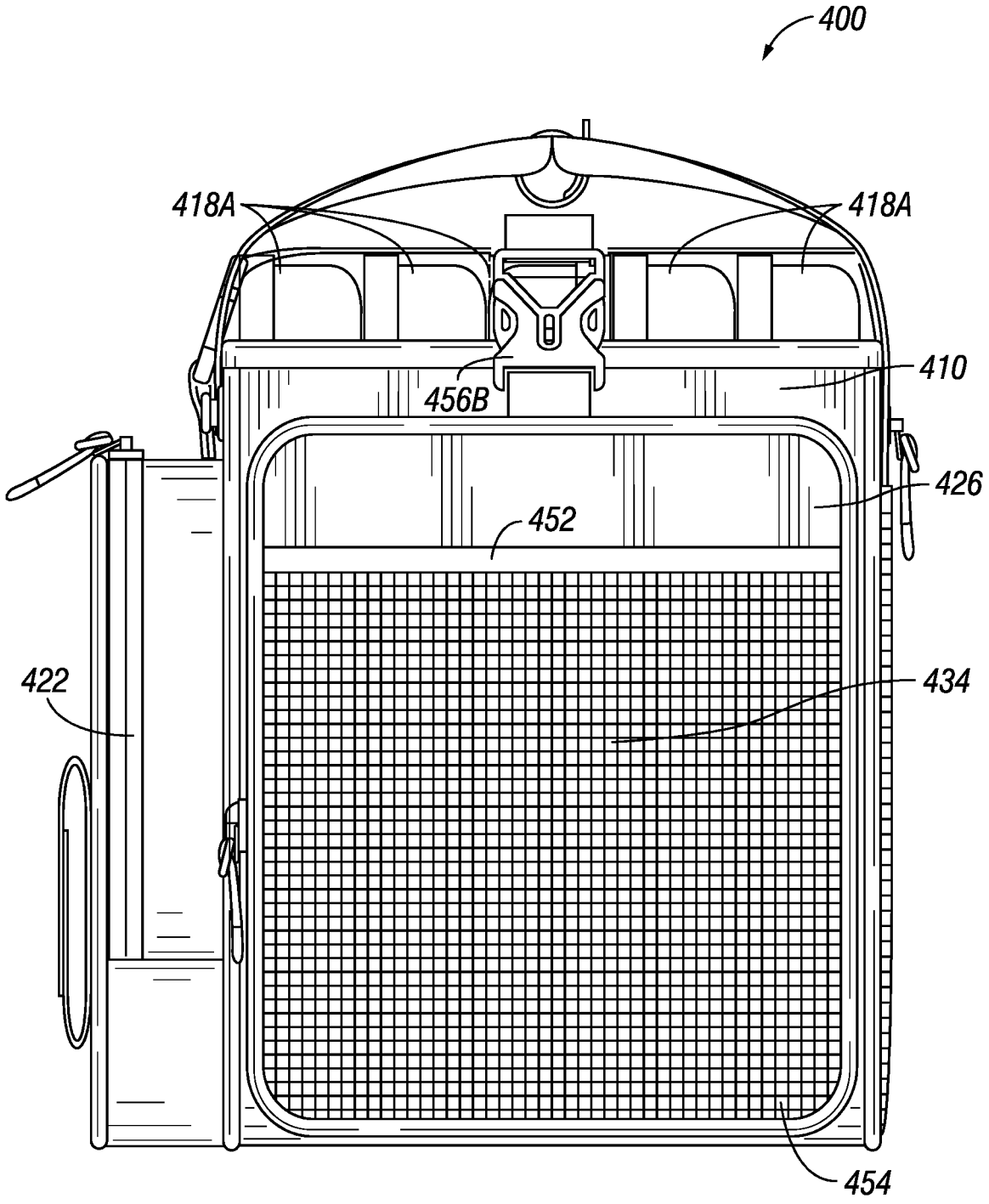
FIG. 4 is an illustration of a right side elevation view of a storage apparatus.

FIG. 4 is a right side elevation view illustration of a storage apparatus 400. The storage apparatus 400, in at least one embodiment, has a right wall 410, a rear wall (shown in FIG. 5), a left wall (shown in FIG. 3), and a front wall (shown in FIG. 1) that define a storage void. Each of wall 410, or other walls shown in other figures disclosed herein, may each have a storage pocket 422, 426 or in at least one example, a window pocket defined by a wall and an outer wall section. The storage pocket 422, 426 may have a bottom section (shown in FIG. 1) that is secured to a wall 410, as well as an inner connecting section and an outer connecting section (shown in FIG. 1), wherein the connecting sections are coupled by a securing mechanism (not shown). The connecting sections and the securing mechanism can be coupled together through a stitching or other connection type such as glue, magnets, buttons, snaps, or a combination thereof, or other connection types.

The storage pocket 422, 426 in at least one example, may also have a slip pocket 434 having elastic 452 or other material having elastic properties and attached to the storage pocket 422, 426 or wall 410. In some examples, the elastic 452 or other material may be combined with a webbing or mesh 454 that allows for a configuration that prevents items stored in the slip pocket 434 from being released. The elastic 452 or other material may be attached to the storage pocket 422, 426 or wall 410 through a stitching or other connection type such as glue, magnets, buttons, snaps, or a combination thereof, or other connection types.

Additional material sections may be added to the storage pockets 422, 426, or wall 410 for stability or accenting. In at least one example, the material sections may allow for a holster or loop strap to be coupled to the storage apparatus 400. The holster or loop strap can be configured to receive a coupling device(s) or items such as but not limited to carabiners, locks, rope, string, netting, coats, cases, cords, glasses, straps, combinations thereof, or other devices or items. A pass-through aperture or plug may allow for cords or cables, such as but not limited to earphones, headphones, charging cables to pass through and be coupled to various devices. A set of securing points 456B can be coupled to wall 410 and configured to allow for a strap or fluid resistant cover to be utilized. In at least one example, a fluid resistant cover allows for fluid to be prevented from entering a storage void. One or more securing straps (shown in FIG. 1) may also be coupled to the wall 410, or storage pockets 422, 426, to secure one or more storage containers 418A within a storage void. The securing straps can utilize buckles or snaps, or other manners of securing to ensure that the storage containers cannot be removed from the storage void without deliberate action from a user. In at least one example, the securing straps may include multiple sections or portions that may individually be coupled to a wall 410, or storage pockets 422, 426, at one end (first end), and have a portion of a multi-point securing mechanism at a second end distal from the first end, to allow for all the sections or portions to be secured together. One or more carrying straps may also be utilized, along with a handle that may be coupled to one of the carrying straps in some examples.

The storage containers 418A, which may be a set of storage containers 418A, allow for items to be stored or organized within the storage void. The storage containers 418A in at least one embodiment, have a two-tone or multi-tone coloring that allows for a distinction between each of the storage containers 418A if different colors are utilized.

For example, a first storage container may be blue and black, while a second storage container is green and black, while a third storage container is red and blue. A user may keep a first type of devices in the first storage container, a second type of devices in the second storage container, and a third type of devices in the third storage container. The visual differences provided by the multi-tone coloring of the storage containers 418A allows for quick identification of which storage container contains which type of device or item. This quick identification is further assisted by the open nature of the storage void, which allows for a portion of each storage container 418A to be visible above the wall 410, or other walls. In some examples, the multi-tone coloring also can assist in preventing sun, ultraviolet, or other finish damage to items stored within the storage containers 418A.

Figure 5:
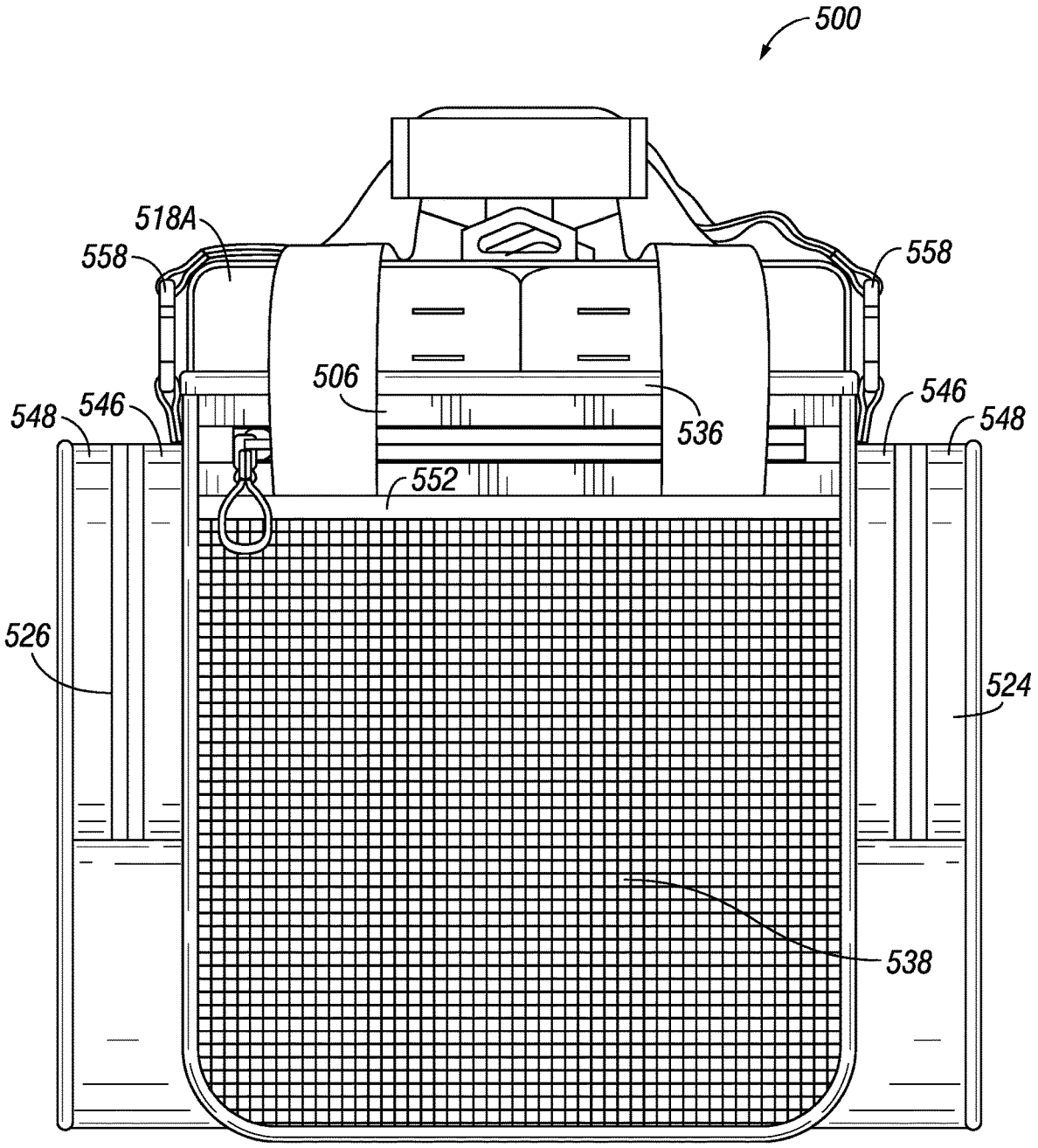
FIG. 5 is an illustration of a rear elevation view of a storage apparatus.

FIG. 5 is a rear elevation view illustration of a storage apparatus 500. The storage apparatus 500, in at least one embodiment, has a right wall (shown in FIG. 4), a rear wall 506, a left wall (shown in FIG. 3), and a front wall (shown in FIG. 1) that define a storage void. Each of wall 506 or other walls shown in other figures disclosed herein may each have a storage pocket 524, 526, 536 or in at least one example, a window pocket defined by a wall and an outer wall section. The storage pocket 524, 526, 536 may have a bottom section (shown in FIG. 1) that is secured to a wall 506, as well as an inner connecting section 546 and an outer connecting section 548, wherein the connecting sections are coupled by a securing mechanism (not shown). The connecting sections 546, 548 and the securing mechanism can be coupled together through a stitching or other connection type such as glue, magnets, buttons, snaps, or a combination thereof, or other connection types.

The storage pocket 524, 526, 536 in at least one example, may also have a slip pocket 538 having elastic 552 or other material having elastic properties and attached to the storage pocket 524, 526, 536 or wall 506. In some examples, the elastic 552 or other material may be combined with a webbing or mesh 538 that allows for a configuration that prevents items stored in the slip pocket 538 from being released. The elastic 552 or other material may be attached to the storage pocket 524, 526, 536 or wall 506 through a stitching or other connection type such as glue, magnets, buttons, snaps, or a combination thereof, or other connection types.

Additional material sections may be added to the storage pockets 524, 526, 536, or wall 506 for stability or accenting. In at least one example, the material sections may allow for a holster or loop strap to be coupled to the storage apparatus 500. The holster or loop strap can be configured to receive a coupling device(s) or items such as but not limited to carabiners, locks, rope, string, netting, coats, cases, cords, glasses, straps, combinations thereof, or other devices or items. A pass-through aperture or plug may allow for cords or cables, such as but not limited to earphones, headphones, charging cables to pass through and be coupled to various devices. A set of securing points 558 can be coupled to wall 506 and configured to allow for a strap or fluid resistant cover to be utilized. In at least one example, a fluid resistant cover allows for fluid to be prevented from entering a storage void. One or more securing straps may also be coupled to the wall 506, or storage 524, 526, 536, to secure one or more storage containers 518A within a storage void. The securing straps can utilize buckles or snaps or other manners of securing to securing points 558 to ensure that the storage containers cannot be removed from the storage void without deliberate action from a user. In at least one example, the securing straps may include multiple sections or portions that may individually be coupled to a wall 506, or storage pockets 524, 526, 536, at one end (first end) and have a portion of a multi-point securing mechanism at a second end distal from the first end, to allow for all the sections or portions to be secured together. One or more carrying straps may also be utilized, along with a handle that may be coupled to one of the carrying straps in some examples.

The storage containers 518A, which may be a set of storage containers 518A, allow for items to be stored or organized within the storage void. The storage containers 518A in at least one embodiment, have a two-tone or multi-tone coloring that allows for a distinction between each of the storage containers 518A if different colors are utilized.

For example, a first storage container may be blue and black, while a second storage container is green and black, while a third storage container is red and blue. A user may keep a first type of devices in the first storage container, a second type of devices in the second storage container, and a third type of devices in the third storage container. The visual differences provided by the multi-tone coloring of the storage containers 518A allow for quick identification of which storage container contains which type of device or item. This quick identification is further assisted by the open nature of the storage void, which allows for a portion of each storage container 518A to be visible above the wall 506, or other walls. In some examples, the multi-tone coloring also can assist in preventing sun, ultraviolet, or other finish damage to items stored within the storage containers 518A.

Window pocket 536 can be defined by the wall 506 or other walls, or one or more storage pockets. The window pocket 536 may have a securing mechanism, such as, but not limited to, a zipper, snaps, buttons, magnets, or other securing devices or combination thereof to close an opening that allows for items to be placed within the window pocket 536. In at least one example, the window pocket 536 may also have material coupled to it that creates a space or void sufficient to receive or hold an item placed within the window pocket 536.

Figure 6:
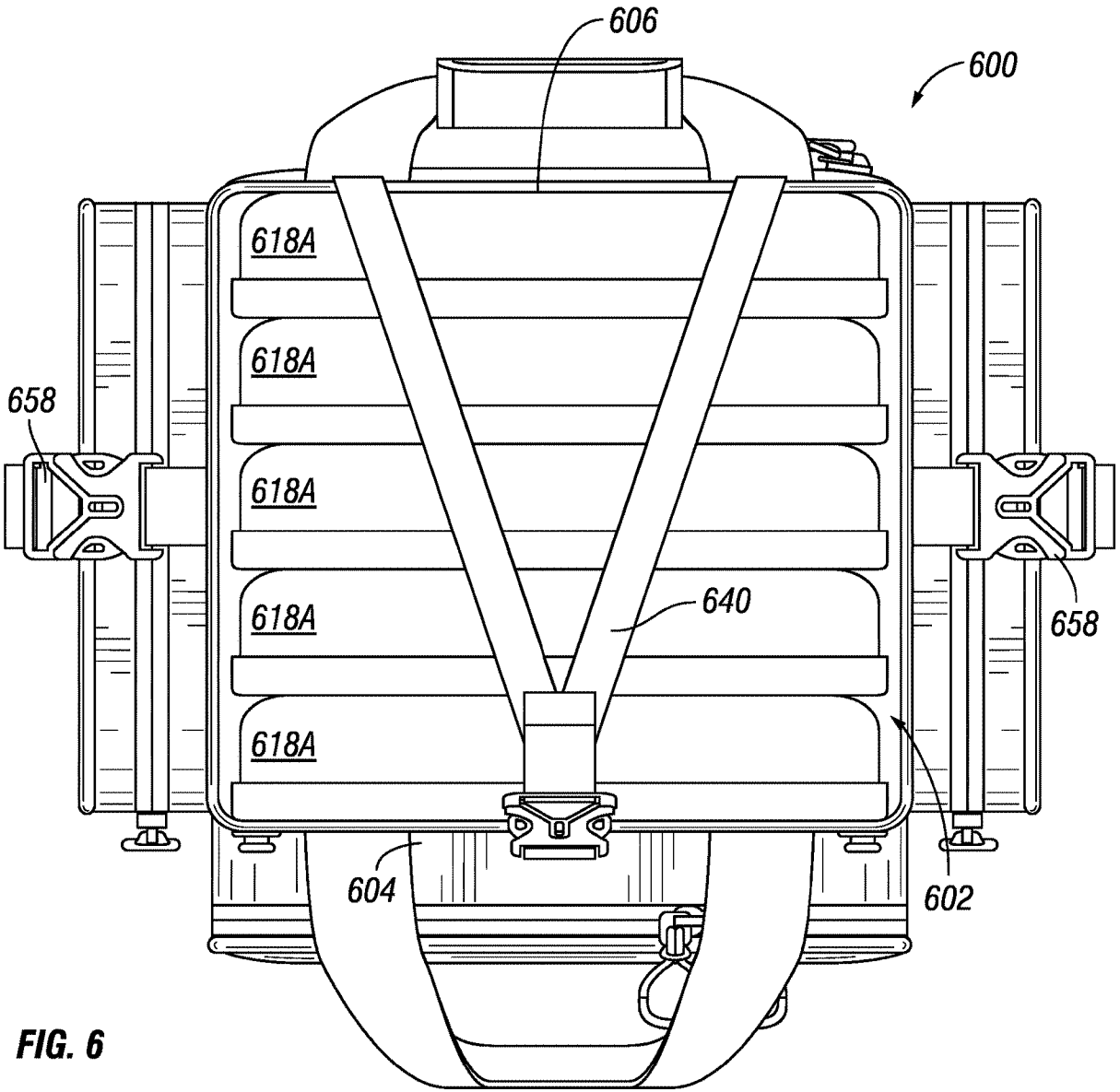
FIG. 6 is an illustration of a top view of a storage apparatus.

FIG. 6 is a top view illustration of a storage apparatus 600. The storage apparatus 600 may be configured to include a storage void strap 640. The storage void strap 640 comprises at least two sections, a proximal end and a distal end, which are connected by a securing device such as a clip or a clasp. The proximal end is configured to connect to the front wall 604 and the distal end is configured to connect to the back wall 606. In at least one example, the storage void strap 640 is adjustable to compress the walls 604, 606 against the one or more storage containers 618A in the storage void 602. A storage void 602 allows for storage containers 618A to be stored or contained in a manner that allows for additional items or containers to be sorted or organized. Securing straps 658 also assist in keeping storage containers 618A secured within the storage void 602.

FIG. 7 is a bottom view illustration of a storage apparatus 700. The storage apparatus 700 may have a bottom 712 constructed of a material that is fluid resistant and have one or more fluid apertures 714 that allow for fluid to flow out of the storage void when the storage apparatus 700 is in an upright position. The bottom wall 712 is coupled to the front wall (shown in FIG. 1), the rear wall (shown in FIG. 5), the left wall (shown in FIG. 3), and the right wall (shown in FIG. 4). The bottom wall 712 is distal from an opening (not shown) defined by the storage void (shown in FIG. 1) and the walls.

Figure 8:
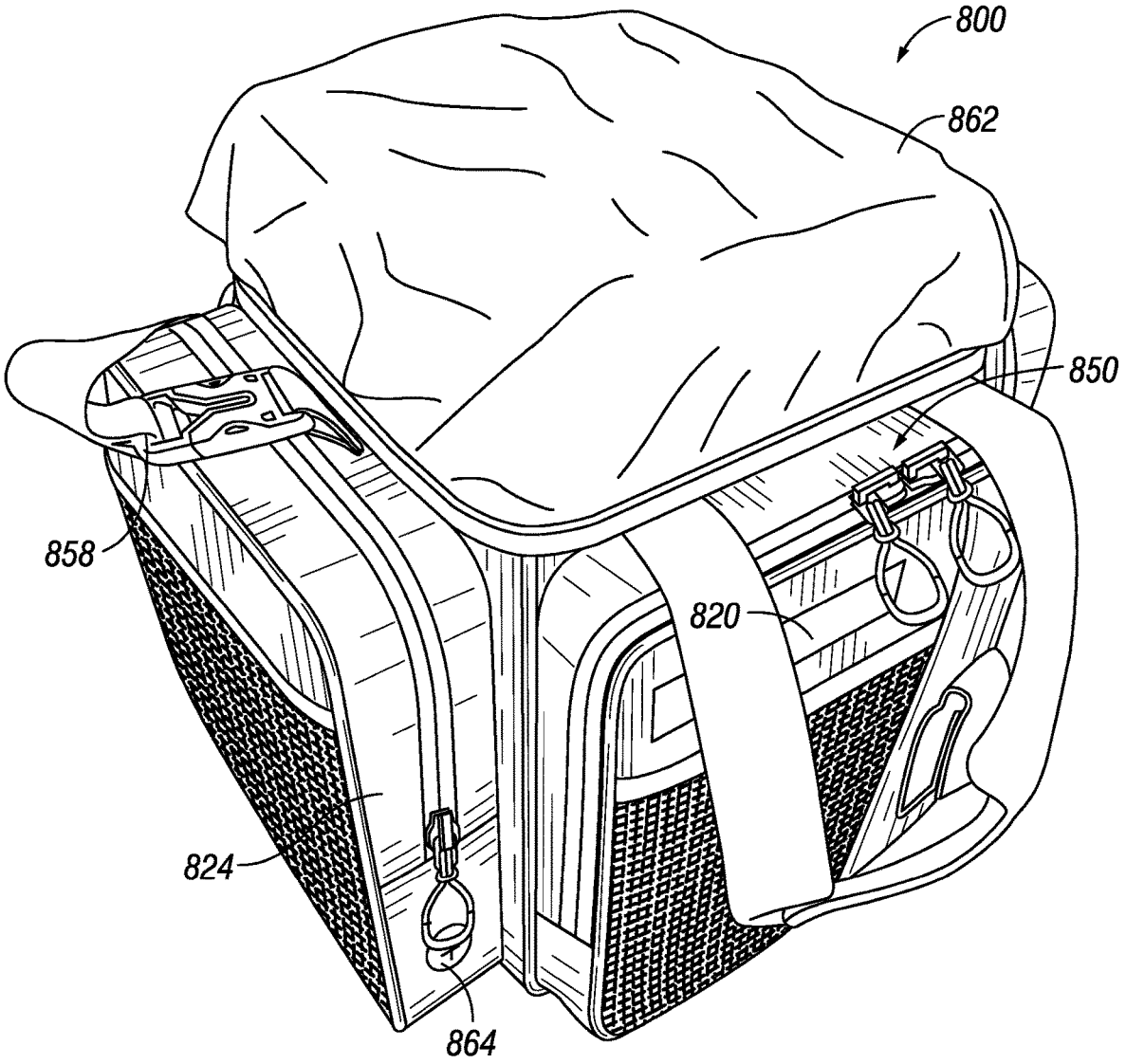
FIG. 8 is an illustration of an environmental prospective view of a storage apparatus.

FIG. 8 is an environmental perspective view illustration of a storage apparatus 800. The storage apparatus 800, in at least one embodiment, has a front wall (shown in FIG. 1), a rear wall (shown in FIG. 5), a left wall (shown in FIG. 3), a right wall (shown in FIG. 4) that define a storage void. Each of the walls or other walls shown in other figures disclosed herein may each have a storage pocket 820, 824, or in at least one example, a window pocket defined by a wall and an outer wall section. The walls are formed of a semi-rigid material that allows for integration of the walls to one another with a single overlapping seam (shown in FIG. 7). The storage pocket 820, 824 may have a bottom section that is secured to a wall, as well as an inner connecting section (shown in FIG. 1), and an outer connecting section (shown in FIG. 1), wherein the connecting sections or are coupled by a securing mechanism (shown in FIG. 1). The connecting sections or and the securing mechanism can be coupled together through a stitching or other connection type such as glue, magnets, buttons, snaps, or a combination thereof, or other connection types.

The storage pocket 820, 824, in at least one example, may also have a slip pocket having elastic or other material having elastic properties and attached to the storage pocket 820, 824 or walls. In some examples, the elastic or other material may be combined with a webbing or mesh that allows for a configuration that prevents items stored in the slip pocket from being released. The elastic or other material may be attached to the storage pocket or wall through a stitching or other connection type such as glue, magnets, buttons, snaps, or a combination thereof, or other connection types.

Additional material sections may be added to the storage pockets 820, 824 or walls for stability or accenting. In at least one example, the material sections may allow for a holster or loop strap to be coupled to the storage apparatus. The holster or loop strap can be configured to receive a coupling device(s) or items such as but not limited to carabiners, locks, rope, string, netting, coats, cases, cords, glasses, straps, combinations thereof, or other devices or items. A pass-through aperture or plug 864 may allow for cords or cables, such as but not limited to earphones, headphones, charging cables to pass through and be coupled to various devices. A set of securing points can be coupled to a wall and configured to allow for a strap. One or more securing straps 858 may also be coupled to the walls or storage pockets 820, 824 to secure one or more storage containers within a storage void. The securing straps 858 can utilize buckles or snaps, or other manners of securing to ensure that the storage containers cannot be removed from the storage void without deliberate action from a user. In at least one example, the securing straps 858 may include multiple sections or portions that may individually be coupled to walls, or storage pockets 820, 824, at one end (first end) and have a portion of a multi-point securing mechanism at a second end distal from the first end, allow for all the sections or portions to be secured together. One or more carrying straps may also be utilized, along with a handle that may be coupled to one of the carrying straps in some examples.

The storage apparatus 800 may have a fluid resistant cover 862 that can assist in prevent fluid from building up within the storage void. In at least one example, the fluid resistant cover 862 may include an elastic band or other elastic like material that can be secured to the securing points shown in FIG. 1. The fluid resistant cover 862 may be coupled on one or more sides to the wall(s) or storage pockets.

Figure 9:
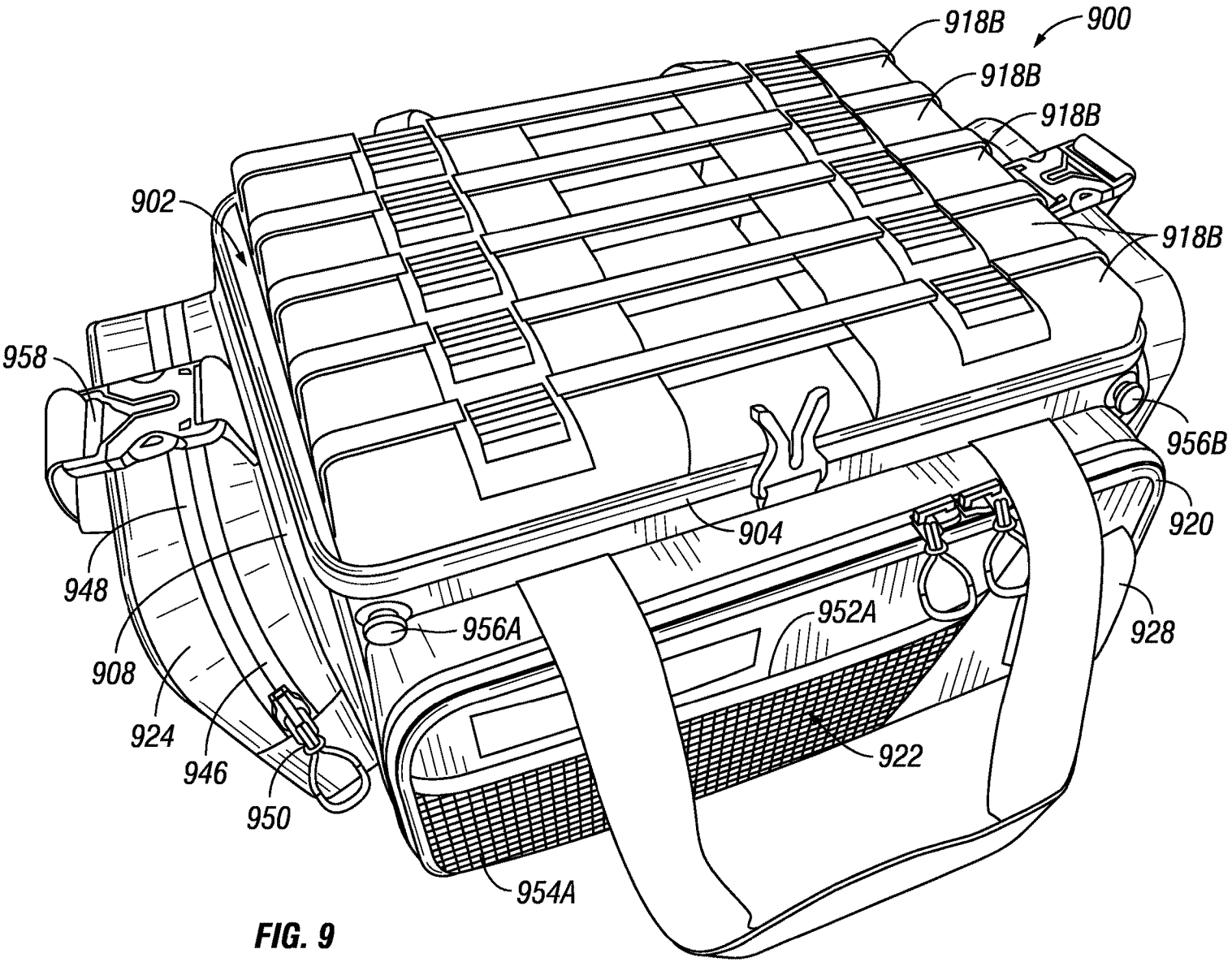
FIG. 9 is an illustration of a front perspective view of a storage apparatus
Figure 15:
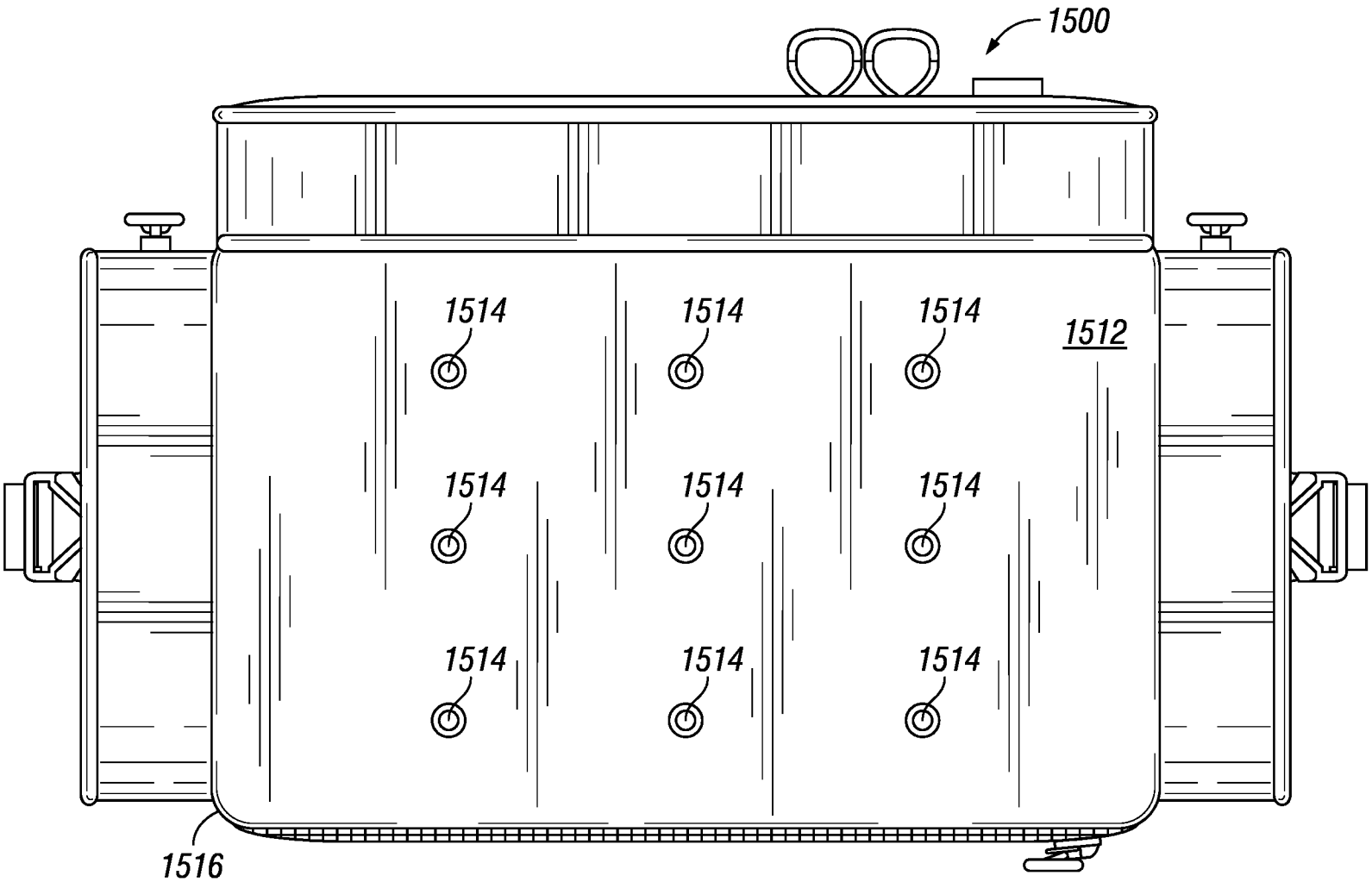
FIG. 15 is an illustration of a bottom view of a storage apparatus

FIG. 9 is a front perspective view illustration of a configuration for a storage apparatus 900. The storage apparatus 900, in at least one embodiment, has a front wall 904, a rear wall (shown in FIG. 13), a left wall 908, and a right wall (shown in FIG. 12) that define a storage void. Each of the walls 904, 908, or other walls shown in other figures disclosed herein, may each have a storage pocket 920, 924, or in at least one example, a window pocket defined by a wall and an outer wall section. The walls are formed of a semi-rigid material that allows for integration of the walls to one another with a single overlapping seam 1516 (FIG. 15). The storage pocket 920, 924 may have a bottom section that is secured to a wall 904 or 908, as well as an inner connecting section 946, and an outer connecting section 948, wherein the connecting sections 946 or 948 are coupled by a securing mechanism 950. The connecting sections 946 or 948 and the securing mechanism 950 can be coupled together through a stitching or other connection type such as glue, magnets, buttons, snaps, or a combination thereof, or other connection types.

The storage pocket 920, 924, in at least one example, may also have a slip pocket 922 having elastic 952A or other material having elastic properties and attached to the storage pocket 920, 924 or walls 904, 908. In some examples, the elastic 952A or other material may be combined with a webbing or mesh 954A that allows for a configuration that prevents items stored in the slip pocket 922 from being released. The elastic 952A or other material may be attached to the storage pocket 920, 924 or walls 904, 908 through a stitching or other connection type such as glue, magnets, buttons, snaps, or a combination thereof, or other connection types.

Additional material sections may be added to the storage pockets 920, 924, or walls 904 or 908 for stability or accenting. In at least one example, the material sections may allow for a holster or loop strap 928 to be coupled to the storage apparatus 900. The holster or loop strap 928 can be configured to receive a coupling device(s) or items such as but not limited to carabiners, locks, rope, string, netting, coats, cases, cords, glasses, straps, combinations thereof, or other devices or items. A pass-through aperture or plug (not shown) may allow for cords or cables, such as but not limited to earphones, headphones, charging cables to pass through and be coupled to various devices. A set of securing points 956A or 956B can be coupled to wall 904 or 908 and configured to allow for a strap or fluid resistant cover to be utilized. In at least one example, a fluid resistant cover allows for fluid to be prevented from entering a storage void. One or more securing straps 958 may also be coupled to the walls 904 or 908, or storage pockets 920, 924, to secure one or more storage containers 918B within a storage void 902. The securing straps 958 can utilize buckles or snaps, or other manners of securing to ensure that the storage containers cannot be removed from the storage void without deliberate action from a user. In at least one example, the securing straps 958 may include multiple sections or portions that may individually be coupled to walls 904 or 908, or storage pockets 920, 924, at one end (first end), and have a portion of a multi-point securing mechanism at a second end distal from the first end, to allow for all the sections or portions to be secured together. One or more carrying straps may also be utilized, along with a handle that may be coupled to one of the carrying straps in some examples.

Figure 10:
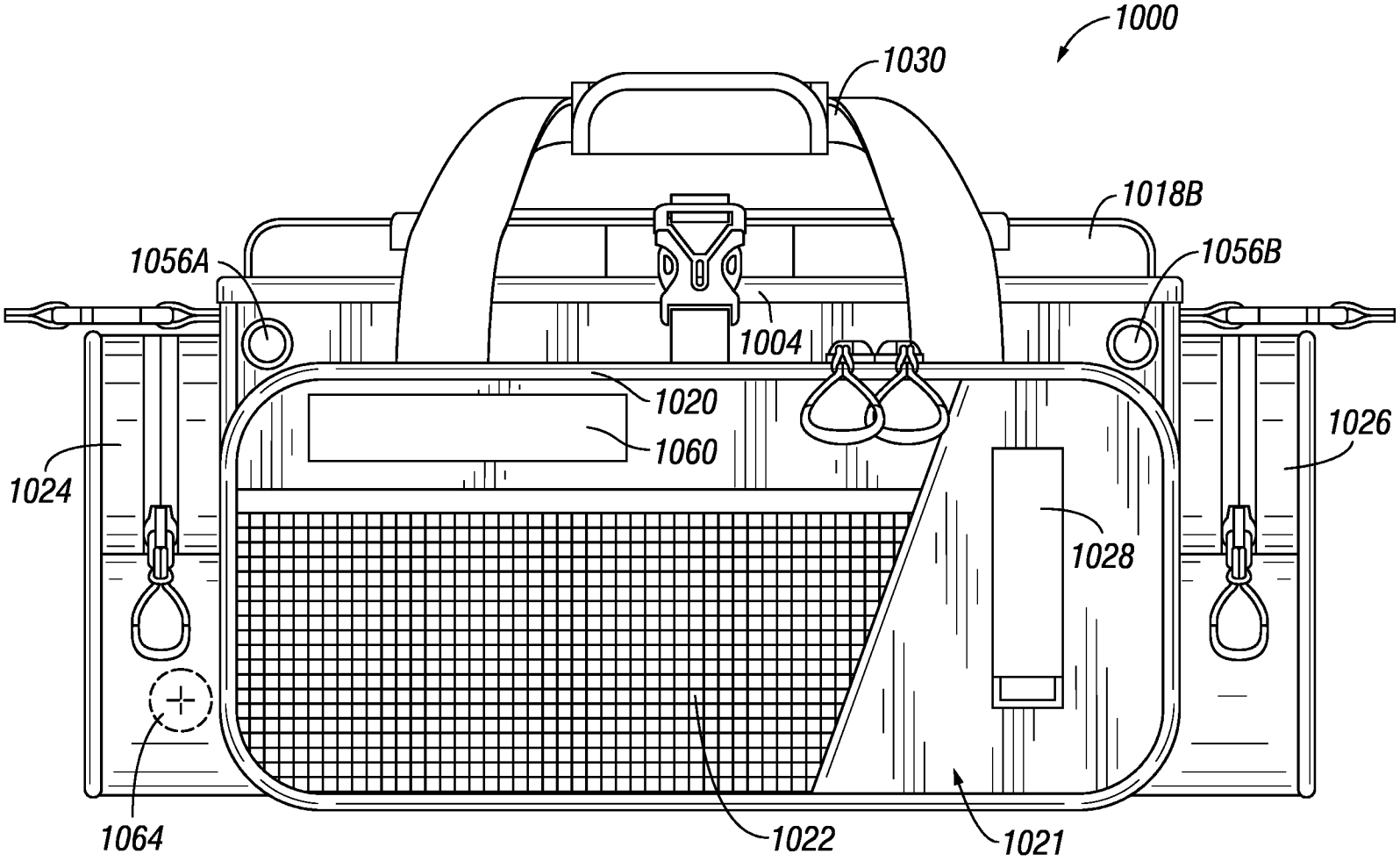
FIG. 10 is an illustration of a front elevation view of a storage apparatus

FIG. 10 is a front elevation view illustration of a storage apparatus 1000. The storage apparatus 1000, in at least one embodiment, has a front wall 1004, a rear wall (shown in FIG. 13), a left wall (shown in FIG. 11), and a right wall (shown in FIG. 12) that define a storage void. Each of the walls 1004, or other walls shown in other figures disclosed herein, may each have a storage pocket 1020 or in at least one example, a window pocket defined by a wall and an outer wall section. The storage pocket 1020 may have a bottom section that is secured to a wall, as well as an inner connecting section and an outer connecting section, wherein the connecting sections are coupled by a securing mechanism. The connecting sections and the securing mechanism can be coupled together through a stitching or other connection type such as glue, magnets, buttons, snaps, or a combination thereof, or other connection types.

The storage pocket 1020 in at least one example, may also have a slip pocket 1022 having elastic or other material having elastic properties and attached to the storage pocket 1020 or wall 1004. In some examples, the elastic or other material may be combined with a webbing or mesh that allows for a configuration that prevents items stored in the slip pocket 1022 from being released. The elastic or other material may be attached to the storage pocket 1020 or wall 1004 through a stitching or other connection type such as glue, magnets, buttons, snaps, or a combination thereof, or other connection types.

Additional material sections 1021 may be added to the storage pockets 1020 or wall 1004 for stability or accenting. In at least one example, the material sections may allow for a holster or loop strap 1028 to be coupled to the storage apparatus 1000. The holster or loop strap 1028 can be configured to receive a coupling device(s) or items such as but not limited to carabiners, locks, rope, string, netting, coats, cases, cords, glasses, straps, combinations thereof, or other devices or items. A pass-through aperture or plug 1064 may allow for cords or cables, such as but not limited to earphones, headphones, charging cables to pass through and be coupled to various devices. A set of securing points 1056A or 1056B can be coupled to wall 1004 and configured to allow for a strap or fluid resistant cover to be utilized. In at least one example, a fluid resistant cover allows for fluid to be prevented from entering a storage void. One or more securing straps may also be coupled to the wall 1004, or storage pockets 1020 to secure one or more storage containers 1018B within a storage void. The securing straps can utilize buckles or snaps, or other manners of securing to ensure that the storage containers cannot be removed from the storage void without deliberate action from a user. In at least one example, the securing straps may include multiple sections or portions that may individually be coupled to wall 1004, or storage pockets 1020 at one end (first end), and have a portion of a multi-point securing mechanism at a second end distal from the first end, to allow for all the sections or portions to be secured together. One or more carrying straps may also be utilized, along with a handle 1030 that may be coupled to one of the carrying straps in some examples.

The storage pockets 1020, 1024, 1026 or wall 1004 may also have an advertising tag 1060 that allows for branding or other accenting. In at least one example, the advertising tag 1060 may be stitched, glued, or otherwise affixed to the storage pockets 1020, 1024, 1026 or wall 1004.

Figure 11:
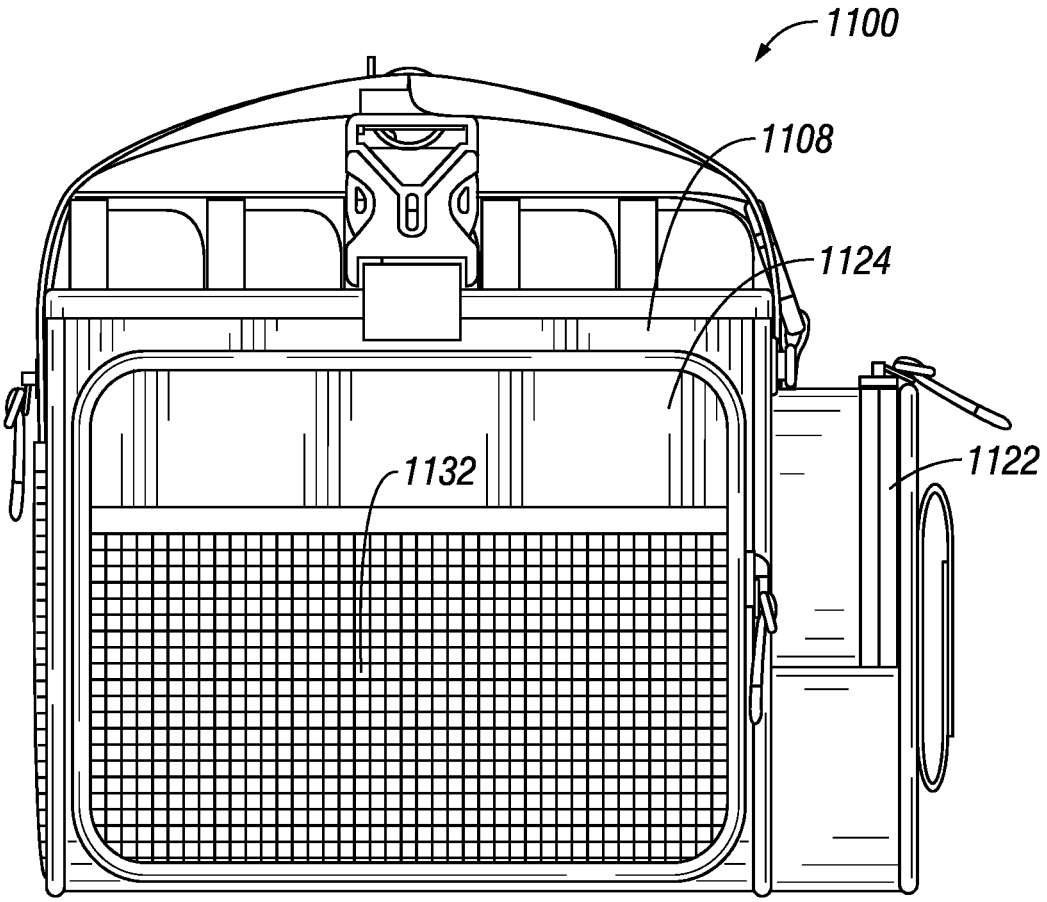
FIG. 11 is an illustration of a left side elevation view of a storage apparatus

FIG. 11 is a left side elevation view illustration of a storage apparatus 1100. The storage apparatus 1100, in at least one embodiment, has a left wall 1108, a rear wall (shown in FIG. 13), a right wall (shown in FIG. 12), and a front wall (shown in FIG. 9) that define a storage void. Each of wall 1008, or other walls shown in other figures disclosed herein, may each have a storage pocket 1122, 1124 or in at least one example, a window pocket defined by a wall and an outer wall section. The storage pocket 1122, 1124 may have a bottom section (shown in FIG. 15) that is secured to wall 1008, as well as an inner connecting section and an outer connecting section (shown in FIG. 9), wherein the connecting sections are coupled by a securing mechanism. The connecting sections and the securing mechanism can be coupled together through a stitching or other connection type such as glue, magnets, buttons, snaps, or a combination thereof, or other connection types.

The storage pockets 1122, 1124 in at least one example may also have a slip pocket 1132 having elastic or other material having elastic properties and attached to the storage pocket 1132 or wall 1108. In some examples, the elastic or other material may be combined with a webbing or mesh that allows for a configuration that prevents items stored in the slip pocket 1132 from being released. The elastic or other material may be attached to the storage pocket 1122, 1124 or wall 1108 through a stitching or other connection type such as glue, magnets, buttons, snaps, or a combination thereof, or other connection types.

Additional material sections may be added to the storage pockets 1122, 1124, or wall 1108 for stability or accenting. In at least one example, the material sections may allow for a holster or loop strap to be coupled to the storage apparatus 1100. The holster or loop strap can be configured to receive a coupling device(s) or items such as but not limited to carabiners, locks, rope, string, netting, coats, cases, cords, glasses, straps, combinations thereof, or other devices or items. A pass-through aperture or plug may allow for cords or cables, such as but not limited to earphones, headphones, charging cables, to pass through and be coupled to various devices. A set of securing points can be coupled to wall 1108 and configured to allow for a strap or fluid resistant cover to be utilized. In at least one example, a fluid resistant cover allows for fluid to be prevented from entering a storage void. One or more securing straps (shown in FIG. 9) may also be coupled to wall 1108 or storage pockets 1122, 1124 to secure one or more storage containers within a storage void. The securing straps can utilize buckles or snaps, or other manners of securing to ensure that the storage containers cannot be removed from the storage void without deliberate action from a user. In at least one example, the securing straps may include multiple sections or portions that may individually be coupled to wall 1108 or storage pockets 1122, 1124 at one end (first end), and have a portion of a multi-point securing mechanism at a second end distal from the first end, to allow for all the sections or portions to be secured together. One or more carrying straps may also be utilized, along with a handle that may be coupled to one of the carrying straps in some examples.

The storage containers may be a set of storage containers, allow for items to be stored or organized within the storage void. The storage containers in at least one embodiment, have a two-tone or multi-tone coloring that allows for a distinction between each of the storage containers if different colors are utilized.

For example, a first storage container may be blue and black, while a second storage container is green and black, while a third storage container is red and blue. A user may keep a first type of devices in the first storage container, a second type of devices in the second storage container, and a third type of devices in the third storage container. The visual differences provided by the multi-tone coloring of the storage containers allow for quick identification of which storage container contains which type of device or item. This quick identification is further assisted by the open nature of the storage void, which allows for a portion of each storage container to be visible above wall 1108, or other walls. In some examples, the multi-tone coloring also can assist in preventing sun, ultraviolet, or other finish damage to items stored within the storage containers.

Figure 12:
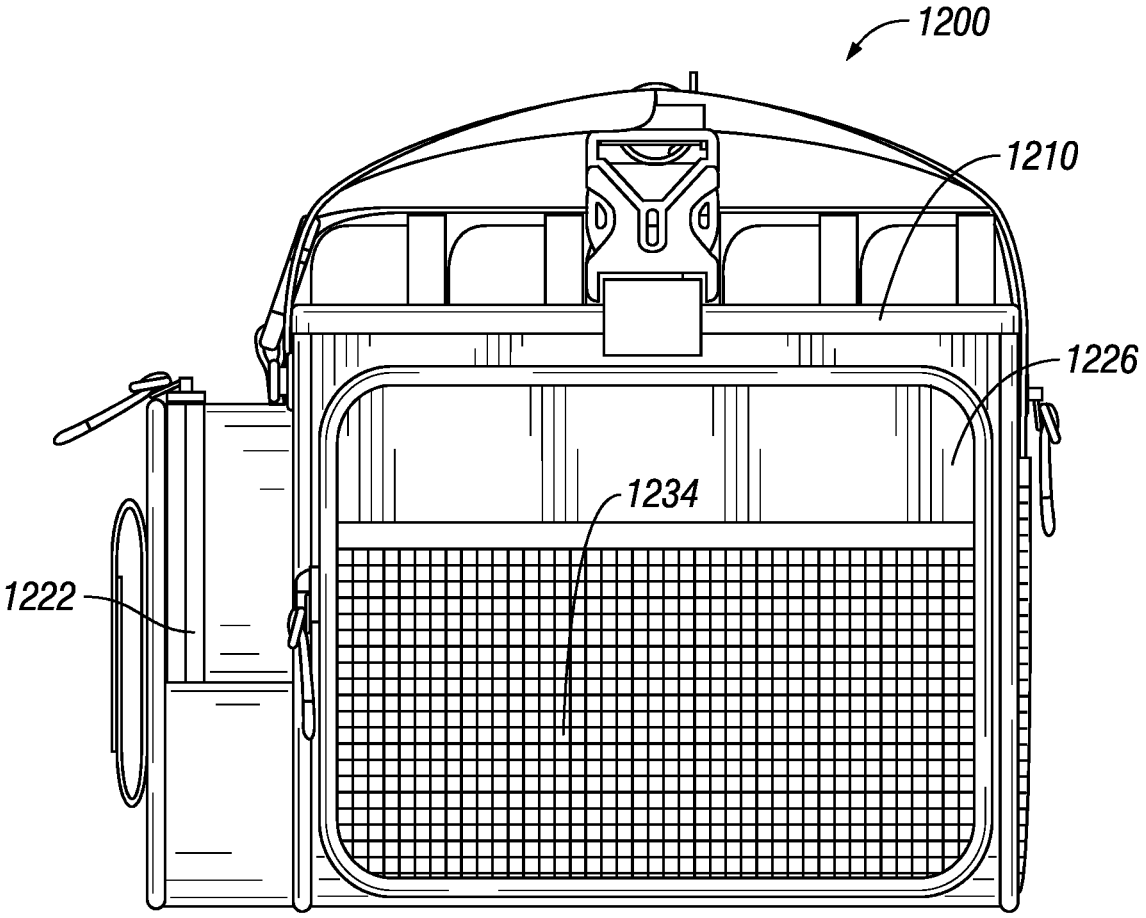
FIG. 12 is an illustration of a right side elevation view of a storage apparatus

FIG. 12 is a right side elevation view illustration of a storage apparatus 1200. The storage apparatus 1200, in at least one embodiment, has a right wall 1210, a rear wall (shown in FIG. 13), a left wall (shown in FIG. 11), and a front wall (shown in FIG. 9) that define a storage void. Each of the walls 1210, or other walls shown in other figures disclosed herein, may each have a storage pocket 1222, 1226 or in at least one example, a window pocket defined by a wall and an outer wall section. The storage pocket 1222, 1226 may have a bottom section (shown in FIG. 15) that is secured to wall 1210, as well as an inner connecting section and an outer connecting section (shown in FIG. 9), wherein the connecting sections are coupled by a securing mechanism (not shown). The connecting sections and the securing mechanism can be coupled together through a stitching or other connection type such as glue, magnets, buttons, snaps, or a combination thereof, or other connection types.

The storage pocket 1222, 1226 in at least one example may also have a slip pocket 1234 having elastic or other material having elastic properties and attached to the storage pocket 1222, 1226 or wall 1210. In some examples, the elastic or other material may be combined with a webbing or mesh that allows for a configuration that prevents items stored in the slip pocket 1234 from being released. The elastic or other material may be attached to the storage pocket 1222, 1226 or wall 1210 through a stitching or other connection type such as glue, magnets, buttons, snaps, or a combination thereof, or other connection types.

Additional material sections may be added to the storage pockets 1222, 1226 or wall 1210 for stability or accenting. In at least one example, the material sections may allow for a holster or loop strap to be coupled to the storage apparatus 1200. The holster or loop strap can be configured to receive a coupling device(s) or items such as but not limited to carabiners, locks, rope, string, netting, coats, cases, cords, glasses, straps, combinations thereof, or other devices or items. A pass-through aperture or plug may allow for cords or cables, such as but not limited to earphones, headphones, charging cables, to pass through and be coupled to various devices. A set of securing points can be coupled to wall 1210 and configured to allow for a strap or fluid resistant cover to be utilized. In at least one example, a fluid resistant cover allows for fluid to be prevented from entering a storage void. One or more securing straps (shown in FIG. 9) may also be coupled to wall 1210 or storage pockets 1222, 1226 to secure one or more storage containers within a storage void. The securing straps can utilize buckles or snaps, or other manners of securing to ensure that the storage containers cannot be removed from the storage void without deliberate action from a user. In at least one example, the securing straps may include multiple sections or portions that may individually be coupled to wall 1210 or storage pockets 1222, 1226 at one end (first end), and have a portion of a multi-point securing mechanism at a second end distal from the first end, to allow for all the sections or portions to be secured together. One or more carrying straps may also be utilized, along with a handle that may be coupled to one of the carrying straps in some examples.

The storage containers, may be a set of storage containers, allow for items to be stored or organized within the storage void. The storage containers in at least one embodiment, have a two-tone or multi-tone coloring that allows for a distinction between each of the storage containers if different colors are utilized.

For example, a first storage container may be blue and black, while a second storage container is green and black, while a third storage container is red and blue. A user may keep a first type of devices in the first storage container, a second type of devices in the second storage container, and a third type of devices in the third storage container. The visual differences provided by the multi-tone coloring of the storage containers allow for quick identification of which storage container contains which type of device or item. This quick identification is further assisted by the open nature of the storage void, which allows for a portion of each storage container to be visible above wall 1210 or other walls. In some examples, the multi-tone coloring also can assist in preventing sun, ultraviolet, or other finish damage to items stored within the storage containers.

Figure 13:
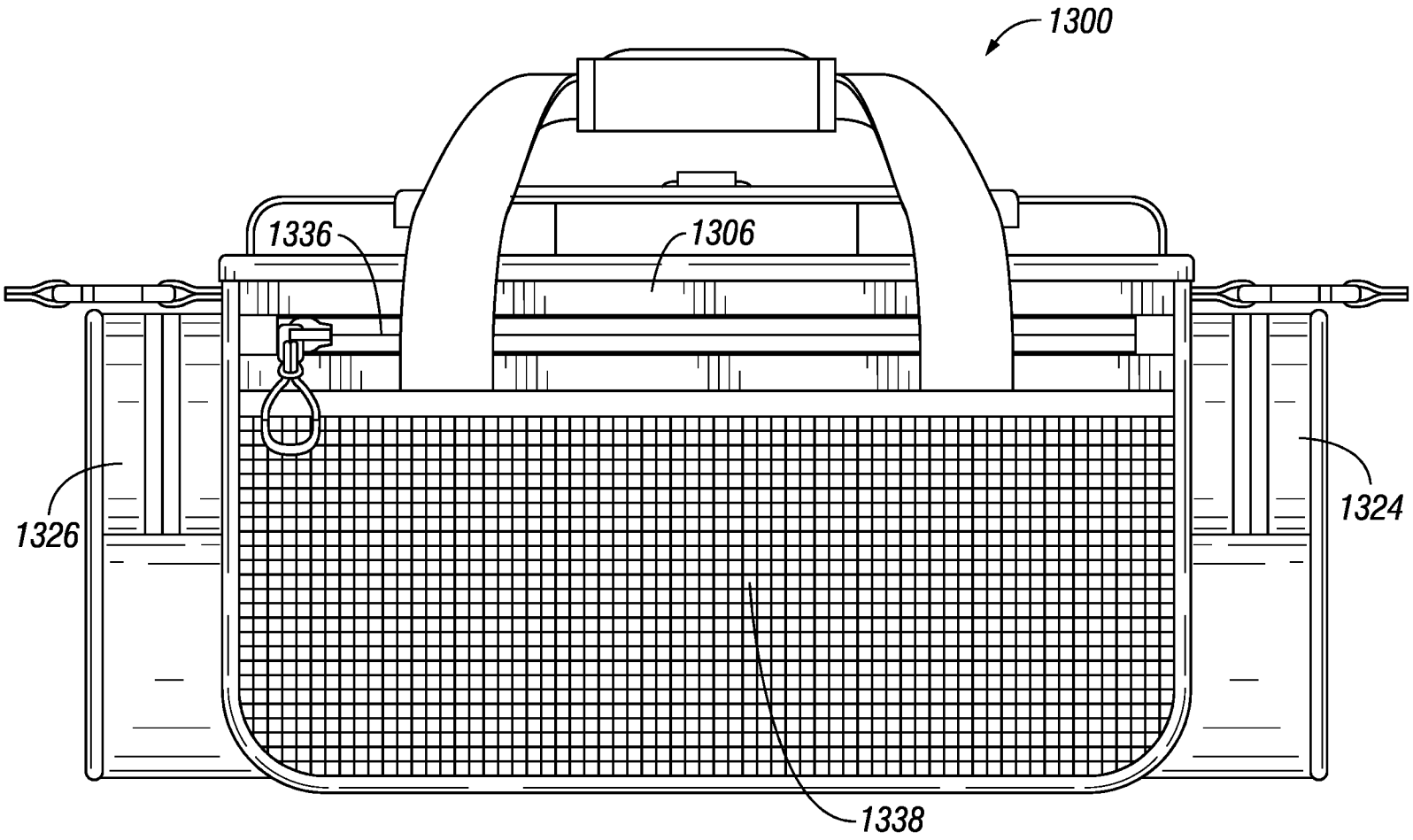
FIG. 13 is an illustration of a rear elevation view of a storage apparatus

FIG. 13 is a rear elevation view illustration of a storage apparatus 1300. The storage apparatus 1300, in at least one embodiment, has a right wall (shown in FIG. 12), a rear wall 1306, a left wall (shown in FIG. 11), and a front wall (shown in shown in FIG. 9) that define a storage void. Each of wall 1306, or other walls shown in other figures disclosed herein, may each have a storage pocket 1324, 1326, 1336, or in at least one example, a window pocket defined by a wall and an outer wall section. The storage pocket 1324, 1326, 1336 may have a bottom section (shown in FIG. 15) that is secured to a wall 1306, as well as an inner connecting section and an outer connecting section, wherein the connecting sections are coupled by a securing mechanism. The connecting sections and the securing mechanism can be coupled together through a stitching or other connection type such as glue, magnets, buttons, snaps, or a combination thereof, or other connection types.

The storage pocket 1324, 1326, 1336 in at least one example may also have a slip pocket 1338 having elastic or other material having elastic properties and attached to the storage pocket 1324, 1326, 1336 or wall 1306. In some examples, the elastic or other material may be combined with a webbing or mesh that allows for a configuration that prevents items stored in the slip pocket 1338 from being released. The elastic or other material may be attached to the storage pocket 1324, 1326, 1336 or wall 1306 through a stitching or other connection type such as glue, magnets, buttons, snaps, or a combination thereof, or other connection types.

Additional material sections may be added to the storage pockets 1324, 1326, 1336 or wall 1306 for stability or accenting. In at least one example, the material sections may allow for a holster or loop strap to be coupled to the storage apparatus 1300. The holster or loop strap can be configured to receive a coupling device(s) or items such as but not limited to carabiners, locks, rope, string, netting, coats, cases, cords, glasses, straps, combinations thereof, or other devices or items. A pass-through aperture or plug may allow for cords or cables, such as but not limited to earphones, headphones, charging cables, to pass through and be coupled to various devices. A set of securing points can be coupled to wall 1306 and configured to allow for a strap or fluid resistant cover to be utilized. In at least one example, a fluid resistant cover allows for fluid to be prevented from entering a storage void. One or more securing straps may also be coupled to wall 1306 or storage pockets 1324, 1326, 1336 to secure one or more storage containers within a storage void. The securing straps can utilize buckles or snaps, or other manners of securing to ensure that the storage containers cannot be removed from the storage void without deliberate action from a user. In at least one example, the securing straps may include multiple sections or portions that may individually be coupled to wall 1306 or storage pockets 1324, 1326, 1336 at one end (first end), and have a portion of a multi-point securing mechanism at a second end distal from the first end, to allow for all the sections or portions to be secured together. One or more carrying straps may also be utilized, along with a handle that may be coupled to one of the carrying straps in some examples.

The storage containers may be a set of storage containers allow for items to be stored or organized within the storage void. The storage containers in at least one embodiment, have a two-tone or multi-tone coloring that allows for a distinction between each of the storage containers if different colors are utilized.

For example, a first storage container may be blue and black, while a second storage container is green and black, while a third storage container is red and blue. A user may keep a first type of devices in the first storage container, a second type of devices in the second storage container, and a third type of devices in the third storage container. The visual differences provided by the multi-tone coloring of the storage containers allow for quick identification of which storage container contains which type of device or item. This quick identification is further assisted by the open nature of the storage void, which allows for a portion of each storage container to be visible above wall 1306 or other walls. In some examples, the multi-tone coloring also can assist in preventing sun, ultraviolet, or other finish damage to items stored within the storage containers.

Window pocket 1336 can be defined by wall 1306 or other walls, or a storage pocket. The window pocket 1336 may have a securing mechanism, such as, but not limited to a zipper, snaps, buttons, magnets, or other securing devices or combination thereof to close an opening that allows for items to be placed within the window pocket. In at least one example, the window pocket 1336 may also have a set of material coupled to it that creates a space or void sufficient to receive or hold an item placed within the window pocket 1336.

Figure 14:
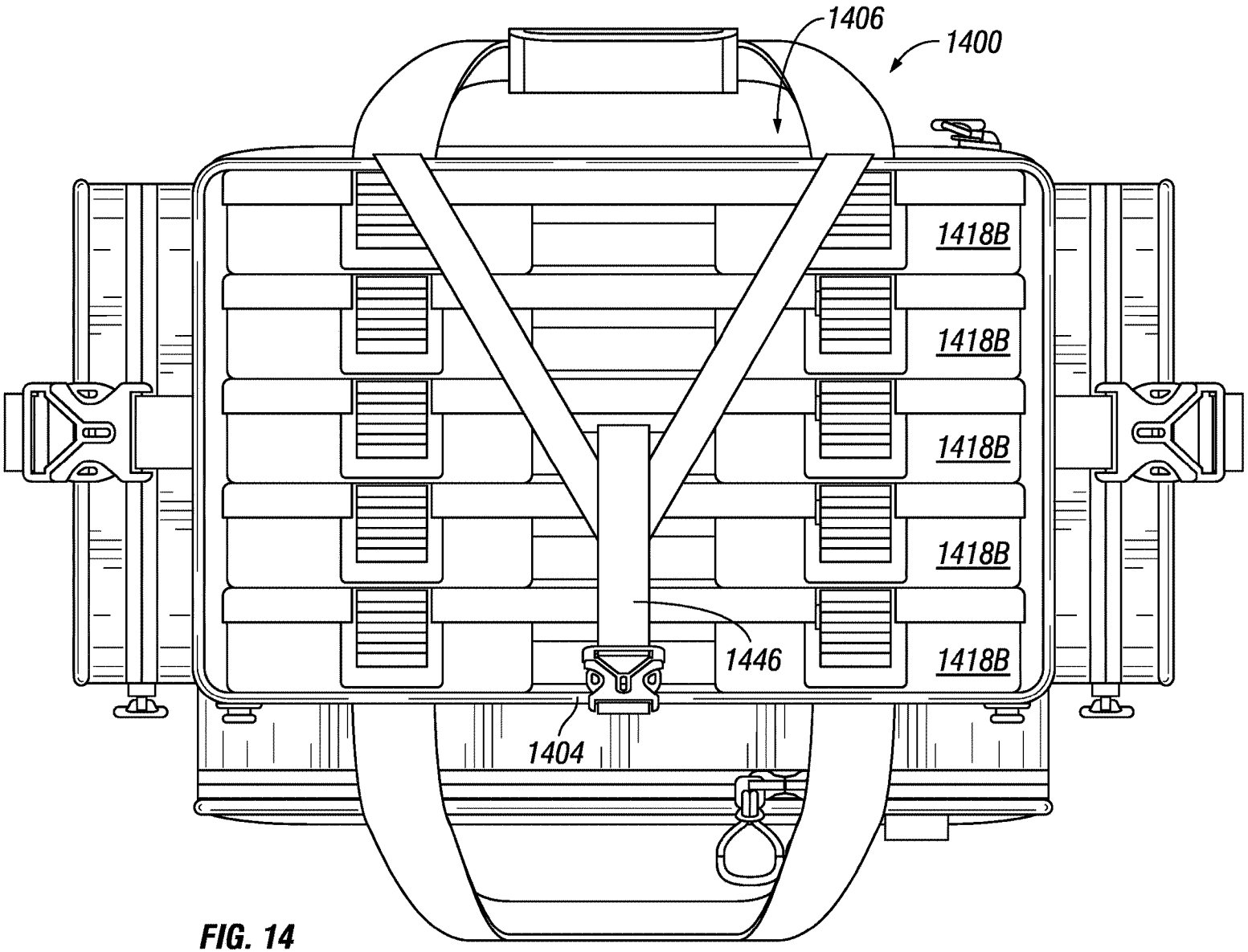
FIG. 14 is an illustration of a top view of a storage apparatus

FIG. 14 is a top view illustration of a storage apparatus 1400. The storage apparatus 1400 may be configured to include a storage void strap 1446. The storage void strap 1446 comprises at least two sections, a proximal end and a distal end, which are connected by a securing device such as a clip or a clasp. The proximal end is configured to connect to the front wall 1404 and the distal end is configured to connect to the back wall 1406. In at least one example, the storage void strap 1446 is adjustable to compress the walls 1404, 1406 against the one or more storage containers 1418B in the storage void. A storage void allows for storage containers 1418B to be stored or contained in a manner that allows for additional items or containers to be sorted or organized. Securing straps also assist in keeping storage containers 1418B secured within the storage void.

FIG. 15 is a bottom view illustration of a storage apparatus 1500. The storage apparatus 1500 may have a bottom 1512 of a material that is fluid resistant and have one or more fluid apertures 1514 that allow for fluid to flow out of the storage void when the storage apparatus 1500 is in an upright position. The bottom wall 1512 is coupled to the front wall (shown in FIG. 9), the rear wall (shown in FIG. 13), the left wall (shown in FIG. 11), and the right wall (shown in FIG. 12). The bottom wall 1512 is distal from an opening (not shown) defined by the storage void and the walls.

Figure 16:
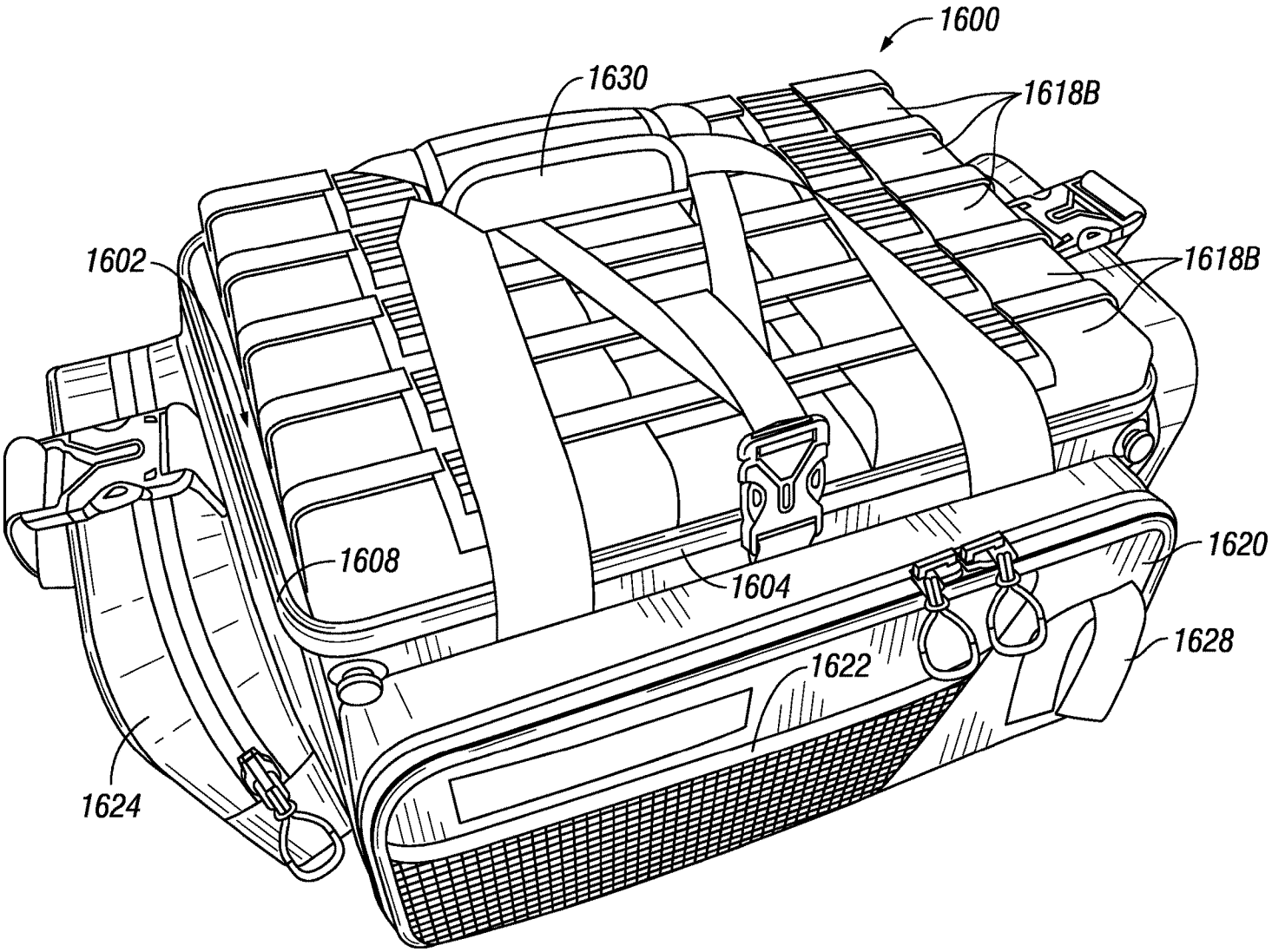
FIG. 16 is an illustration of a front perspective environmental view of a storage apparatus.

FIG. 16 is an environmental perspective view illustration of a storage apparatus 1600. The storage apparatus 1600, in at least one embodiment, has a front wall 1604, a rear wall (shown in FIG. 13), a left wall 1608, and a right wall (shown in FIG. 11) that define a storage void 1602. Each of the walls 1604, 1608 or other walls shown in other figures disclosed herein may each have a storage pocket 1620, 1624, or in at least one example, a window pocket defined by a wall and an outer wall section. The walls 1604, 1608 are formed of a semi-rigid material that allows for integration of the walls to one another with a single overlapping seam (shown in FIG. 15). The storage pockets 1620, 1624 may have a bottom section that is secured to a wall, as well as an inner connecting section (shown in FIG. 9), and an outer connecting section (FIG. 9), wherein the connecting sections or are coupled by a securing mechanism (shown in FIG. 9). The connecting sections or and the securing mechanism can be coupled together through a stitching or other connection type such as glue, magnets, buttons, snaps, or a combination thereof, or other connection types.

The storage pockets 1620, 1624, in at least one example, may also have a slip pocket 1622 having elastic or other material having elastic properties and attached to the storage pocket 1620, 1624 or walls. In some examples, the elastic or other material may be combined with a webbing or mesh that allows for a configuration that prevents items stored in the slip pocket 1622 from being released. The elastic or other material may be attached to the storage pocket or wall through a stitching or other connection type such as glue, magnets, buttons, snaps, or a combination thereof, or other connection types.

Additional material sections may be added to the storage pockets 1620, 1624 or walls for stability or accenting. In at least one example, the material sections may allow for a holster 1628 or loop strap to be coupled to the storage apparatus. The holster or loop strap can be configured to receive a coupling devices or items such as but not limited to carabiners, locks, rope, string, netting, coats, cases, cords, glasses, straps, combinations thereof, or other devices or items. A pass-through aperture or plug may allow for cords or cables, such as but not limited to earphones, headphones, charging cables, to pass through and be coupled to various devices. A set of securing points or can be coupled to one of the walls and configured to allow for a strap or fluid resistant cover to be utilized. In at least one example, a fluid resistant cover allows for fluid to be prevented from entering a storage void. One or more securing straps may also be coupled to the walls or storage pockets 1620, 1624 to secure one or more storage containers 1618B within a storage void. The securing straps can utilize buckles or snaps, or other manners of securing to ensure that the storage containers cannot be removed from the storage void without deliberate action from a user. In at least one example, the securing straps may include multiple sections or portions that may individually be coupled to wall 1604, 1608 or storage pockets 1620, 1624 at one end (first end), and have a portion of a multi-point securing mechanism at a second end distal from the first end, to allow for all the sections or portions to be secured together. One or more carrying straps may also be utilized, along with a handle 1630 that may be coupled to one of the carrying straps in some examples.

The storage apparatus 1600 may have a fluid resistant cover that can assist in prevent fluid from building up within the storage void. In at least one example, the fluid resistant cover may include an elastic band or other elastic like material that can be secured to the securing points shown in FIG. 9. The fluid resistant cover may be coupled on one or more sides to one of the walls or storage pockets.

While this disclosure has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

While various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that certain technology is prior art to any embodiment(s) in this disclosure. Neither is the "Brief Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

I claim:

1. A storage apparatus comprising:

A storage void defined by a front wall, a rear wall, a left wall, a right wall; a bottom wall coupled to the front wall, the rear wall, the left wall, and the right wall, the bottom wall having at least one aperture through the bottom wall, and the bottom wall being distal from an opening defined by the storage void and said front, rear, left and right walls; wherein said walls are formed of a semi-rigid material that allows for integration of said walls to one another with a single overlapping seam;

wherein the storage void is configured to receive one or more storage containers that are visibly discernable from each other in the storage void, and wherein:

each of the one or more storage containers has a depth that is less than its height and width, and a portion of each of the one or more containers are substantially equal to the depth of each of the one or more storage containers and the portion being visible above the front wall, the rear wall, the left wall, and the right wall when each of the one or more storage containers are stored vertically within the storage void with its height being parallel to the bottom wall and the opening; wherein the one or more storage containers comprise a multi-tone color scheme, thereby providing quick identification of each of the one or more storage containers in the storage void; further comprising a storage void strap having a proximal end and a distal end, wherein: the proximal end is removably connected to the front wall and the distal end is connected to the rear wall; the storage void strap is configured to have an adjustable length, thereby enabling compression of the front wall and back wall against the one or more storage containers in the storage void.

2. The storage apparatus of claim 1, further comprising a storage pocket, wherein:

the storage pocket is coupled to the front wall or the rear wall;

the storage pocket is defined by the front wall or the rear wall, a bottom section, an outer wall, and an interconnecting section; and the interconnecting section having an inner section and an outer section that are removably coupled together by a securing device.

3. The storage apparatus of claim 2, further comprising a slip pocket coupled to the outer wall of the storage pocket, wherein the slip pocket comprises an elastic material configured to secure items against the outer wall of the storage pocket.

4. The storage apparatus of claim 1, further comprising a storage pocket, wherein:

the storage pocket is coupled to an exterior of the left wall or the right wall;

the storage pocket is defined by an interior of the left wall or the right wall, a bottom section, an outer wall, and an interconnecting section;

the interconnecting section having an inner section and an outer section that are removably coupled together by a securing device.

5. The storage apparatus of claim 4, further comprising a slip pocket coupled to the outer wall of the storage pocket, wherein the slip pocket comprises an elastic material configured to secure items against the outer wall of the storage pocket.

6. The storage apparatus of claim 5, further comprising a plug located on the interconnecting section, wherein the plug is configured to:

open upon receiving a force from an object, thereby allowing the object to pass through the plug and into the storage pocket, and close around the object.

7. The storage apparatus of claim 1, further comprising at least one securing strap coupled to the left wall and the right wall, wherein the at least one securing strap is configured to have an adjustable length, thereby enabling compression of the left wall and the right wall against the one or more storage containers in the storage void.

8. The storage apparatus of claim 1, further comprising:

a set of securing points coupled the front wall and the back wall; and a cover removably secured to the set of securing points, wherein the cover is configured to prevent a fluid from entering the storage void.

9. A storage apparatus comprising: a storage void defined by a front wall, a rear wall, a left wall and a right wall; a bottom wall coupled to the front wall, the rear wall, the left wall, and the right wall, having at least one aperture through the bottom wall, and the bottom wall being distal from an opening defined by the storage void, and said front, rear, left and right walls; wherein said walls are formed of a semi-rigid material that allows for integration of said walls to one another with a single overlapping seam; wherein the storage void is configured to receive one or more storage containers that are visibly discernable from each other in the storage void, and wherein; each of the one or more storage containers has a depth that is less than its height and width, and a portion of each of the one or more containers is substantially equal to the depth of the of each of the one or more storage containers and the portion being visible above the front wall, the rear wall, the left wall, and the right wall when each of the one or more storage containers are stored vertically within the storage void with its height being parallel to the bottom wall and the opening; and the once ore more storage containers comprise a multi-tone color scheme, thereby providing quick identification of each of the one or more storage containers in the storage void; further comprising a storage void strap and at least one securing strap, wherein: the storage void strap is connected to the front wall and the rear wall; the at least one securing strap is connected to the left wall and the right wall; the storage void strap is configured to have an adjustable length, thereby enabling compression of the front wall and rear wall against the one or more storage containers in the storage void; the at least one securing strap is configured to have an adjustable length, thereby enabling compression of the left wall and right wall against the one or more storage containers in the storage void.

10. The storage apparatus of claim 9, further comprising a first and second storage pocket, wherein:

the first storage pocket is coupled to an exterior of the front wall or the rear wall;

the second storage pocket is coupled to an exterior of the left wall or the right wall;

the first storage pocket is defined by the front wall or the rear wall, a bottom section, an outer wall, and a first interconnecting section;

the second storage pocket is defined by the left wall or the right wall, a bottom section, an outer wall, and a second interconnecting section;

the first and second interconnecting sections having an inner section and an outer section that are removably coupled together by a securing device.

11. The storage apparatus of claim 10, further comprising a first and second slip pocket coupled to the outer walls of the first and second storage pockets, wherein the first and second slip pockets comprise an elastic material configured to secure items against the outer walls of the first and second storage pocket.

12. The storage apparatus of claim 11, further comprising a plug located on the first and second interconnecting sections, wherein the plug is configured to:

open upon receiving a force from an object, thereby allowing the object to pass through the plug and into the storage pocket, and close around the object.

13. The storage apparatus of claim 11, further comprising:

a set of securing points coupled the front wall and the rear wall; and a cover removably secured to the set of securing points, wherein the cover is configured to prevent a fluid from entering the storage void.

14. A storage apparatus comprising:

a storage void defined by a front wall, a rear wall, a left wall and a right wall;

a bottom wall coupled to the front wall, the rear wall, the left wall, and the right wall, have at least one aperture through the bottom wall, and the bottom wall being distal from an opening defined by the storage void, and said front, rear, left and right walls;

wherein said walls are formed of a semi-rigid material that allows for integration of said walls to one another with a single overlapping seam;

the storage void is configured to receive one or more storage containers that are visibly discernable from each other in the storage void;

wherein each of the one or more storage containers has:

a depth that is less than its height and width, and a portion of each of the one or more contains substantially equal to the depth of each of the one or more storage containers and the portion being visible above the front wall, the rear wall, the left wall, and the right wall when each of the one or more storage containers is within the storage void, thereby providing quick identification of each of the one or more storage containers in the storage void;

a fluid resistant material cover having at least one elastic band is configured to secure against the front wall, the rear wall, the left wall, and the right wall;

a storage void strap and at least one securing strap, wherein:

the storage void strap is connected to the front wall and the rear wall;

the at least one securing strap is connected to the left wall and the right wall;

the storage void strap is configured to have an adjustable length, thereby enabling compression of the front wall and rear wall against the one or more storage containers in the storage void; and the at least one securing strap is configured to have an adjustable length, thereby enabling compression of the left wall and right wall against the one or more storage containers in the storage void.

15. The storage apparatus of claim 14, further comprising:

a set of securing points coupled the front wall, the rear wall, the left wall, and the right wall; and a cover removably secured to the set of securing points, wherein the cover is configured to prevent a fluid from entering the storage void.

16. The storage apparatus of claim 14, further comprising a first and second storage pocket, wherein:

the first storage pocket is coupled to an exterior of the front wall or the rear wall;

the second storage pocket is coupled to an exterior of the left wall or the right wall;

the first storage pocket is defined by the front wall or the rear wall, a bottom section, an outer wall, and a first interconnecting section;

the second storage pocket is defined by the left wall or the right wall, a bottom section, an outer wall, and a second interconnecting section;

the first and second interconnecting sections having an inner section and an outer section that are removably coupled together by a securing device.

17. The storage apparatus of claim 16, further comprising a first and second slip pocket coupled to the outer walls of the first and second storage pockets, wherein the first and second slip pockets comprise an elastic material configured to secure items against the outer walls of the first and second storage pocket.

* * * * *